US008763795B1

(12) United States Patent
Oten et al.

(10) Patent No.: US 8,763,795 B1
(45) Date of Patent: Jul. 1, 2014

(54) DUAL SUPPORT FLAP CASE

(71) Applicant: Targus Group International, Inc., Anaheim, CA (US)

(72) Inventors: Remzi Oten, Irvine, CA (US); Fevzi Oten, Aliso Viejo, CA (US)

(73) Assignee: Targus Group International, Inc., Anaheim, CA (US)

( * ) Notice: Subject to any disclaimer, the term of this patent is extended or adjusted under 35 U.S.C. 154(b) by 0 days.

(21) Appl. No.: 13/747,992

(22) Filed: Jan. 23, 2013

(51) Int. Cl.
*B65D 5/52* (2006.01)

(52) U.S. Cl.
USPC ..... 206/45.23; 206/45.24; 206/320

(58) Field of Classification Search
USPC ..... 206/45.24, 45.26, 320, 45.2, 45.23, 206/701, 576
See application file for complete search history.

(56) References Cited

U.S. PATENT DOCUMENTS

| | | | |
|---|---|---|---|
| 910,619 | A | 1/1909 | Weidemann |
| 1,046,843 | A | 12/1912 | Olpp |
| 1,121,422 | A | 12/1914 | Tydings |
| 1,372,126 | A | 3/1921 | Dunham, Jr. |
| 1,374,126 | A | 4/1921 | Walter |
| 1,416,465 | A | 5/1922 | Harvey |
| 1,444,112 | A | 2/1923 | Davis |
| 1,556,352 | A | 10/1925 | Ritter |
| 1,658,174 | A | 2/1928 | Russell |
| 1,721,427 | A | 7/1929 | Aldrich |
| 1,826,976 | A | 10/1931 | Wright |
| 1,889,765 | A | 12/1932 | Switkes |
| 2,018,605 | A | 10/1935 | Craig |
| 2,083,029 | A | 6/1937 | Lowy |
| 2,110,163 | A | 3/1938 | Lobel |
| 2,170,841 | A | 8/1939 | Thies et al. |
| 2,181,587 | A | 11/1939 | Plotkin |
| 2,316,328 | A | 4/1943 | Guenther et al. |
| 2,335,779 | A | 11/1943 | Mazzei |
| 2,503,746 | A | 4/1950 | Klehr |
| 2,554,215 | A | 5/1951 | Schell et al. |
| 2,556,066 | A | 6/1951 | Cline |
| 2,574,146 | A | 11/1951 | Gottesman |

(Continued)

FOREIGN PATENT DOCUMENTS

| | | |
|---|---|---|
| CA | 2 785 813 A1 | 12/2011 |
| CA | 2 758 982 A1 | 5/2012 |

(Continued)

OTHER PUBLICATIONS

Office Action for U.S. Appl. No. 13/791,445, filed Mar. 8, 2013, and mailed from the USPTO on Jun. 21, 2013, 20 pgs.

(Continued)

*Primary Examiner* — Jacob K Ackun
(74) *Attorney, Agent, or Firm* — John R. Thompson; Stoel Rives LLP

(57) ABSTRACT

A dual support flap case comprises a receptacle configured to receive a portable electronic device, a first support flap configured to support the case at a first angle relative to a supporting surface, and a second support flap configured to support the case at a second angle relative to the supporting surface. The first support flap may be a different length than the second support flap. The first and second angles of may allow for a user to select a preferred angle for a current task, such as reading, watching video, typing using a virtual keyboard, typing using a separate physical keyboard, or other task.

22 Claims, 18 Drawing Sheets

(56) References Cited

U.S. PATENT DOCUMENTS

| | | | |
|---|---|---|---|
| 2,589,438 | A | 3/1952 | Schneider |
| 2,653,709 | A | 9/1953 | Cunningham et al. |
| 2,681,142 | A | 6/1954 | Cohen |
| 2,696,322 | A | 12/1954 | Densen |
| 2,700,460 | A | 1/1955 | Hoover |
| 2,700,518 | A | 1/1955 | Ryno et al. |
| 2,769,474 | A | 11/1956 | Klotz |
| 2,771,167 | A | 11/1956 | Lifton |
| 2,771,184 | A | 11/1956 | Ryno et al. |
| 2,785,795 | A | 3/1957 | Ryno et al. |
| 2,800,940 | A | 7/1957 | Riesebeck |
| 2,837,208 | A | 6/1958 | Lingenfelter |
| 2,908,362 | A | 10/1959 | Burtchaell |
| 2,913,080 | A | 11/1959 | Louik et al. |
| D188,582 | S | 8/1960 | Koffler |
| 3,023,868 | A | 3/1962 | Koffler |
| 3,081,807 | A | 3/1963 | Lightburn |
| 3,115,228 | A | 12/1963 | Louik et al. |
| 3,115,229 | A | 12/1963 | Erhard |
| 3,136,413 | A | 6/1964 | Hall |
| 3,176,742 | A | 4/1965 | Kubnick |
| 3,185,198 | A | 5/1965 | Bryan |
| 3,192,978 | A | 7/1965 | Horvath |
| 3,265,168 | A | 8/1966 | Erhard |
| 3,286,751 | A | 11/1966 | Dishart |
| 3,292,778 | A | 12/1966 | Enderle |
| 3,412,521 | A | 11/1968 | Bauman |
| 3,441,072 | A | 4/1969 | Schmitt |
| 3,497,041 | A | 2/1970 | SamHammer |
| 3,500,973 | A | 3/1970 | Bush |
| 3,529,317 | A | 9/1970 | Schwarzkopf |
| 3,530,213 | A | 9/1970 | Isle |
| 3,531,822 | A | 10/1970 | Bush |
| 3,575,781 | A | 4/1971 | Pezely |
| 3,620,149 | A | 11/1971 | Ogihara |
| 3,656,594 | A | 4/1972 | Marks et al. |
| 3,692,155 | A | 9/1972 | Laurita |
| 3,698,404 | A | 10/1972 | Greco |
| 3,752,301 | A | 8/1973 | Bluemel |
| 3,813,729 | A | 6/1974 | Szabo et al. |
| 3,853,220 | A | 12/1974 | Luray |
| 3,912,055 | A | 10/1975 | Malooly |
| 3,912,140 | A | 10/1975 | Franges |
| 3,944,033 | A | 3/1976 | Simson |
| 3,949,879 | A | 4/1976 | Peterson et al. |
| 4,013,170 | A | 3/1977 | Hutterer |
| 4,044,867 | A | 8/1977 | Fisher |
| 4,106,597 | A | 8/1978 | Shook et al. |
| 4,114,761 | A | 9/1978 | Kleiner |
| 4,117,933 | A | 10/1978 | Lachance |
| 4,141,401 | A | 2/1979 | Hindemit |
| 4,189,037 | A | 2/1980 | Szabo |
| 4,212,377 | A | 7/1980 | Weinreb |
| 4,213,520 | A | 7/1980 | Sarna et al. |
| 4,259,568 | A | 3/1981 | Dynesen |
| 4,261,078 | A | 4/1981 | Edwards et al. |
| 4,336,883 | A | 6/1982 | Krug et al. |
| 4,339,039 | A | 7/1982 | Mykleby |
| 4,340,990 | A | 7/1982 | Seynhaeve |
| 4,364,150 | A | 12/1982 | Remington |
| 4,378,866 | A | 4/1983 | Pelavin |
| 4,433,781 | A | 2/1984 | Hummel |
| 4,478,450 | A | 10/1984 | Picozza |
| 4,514,876 | A | 5/1985 | Houlberg |
| 4,569,082 | A | 2/1986 | Ainsworth et al. |
| 4,573,202 | A | 2/1986 | Lee |
| 4,620,633 | A | 11/1986 | Lookholder |
| 4,651,872 | A | 3/1987 | Joyce |
| 4,655,418 | A | 4/1987 | Melahn |
| 4,658,298 | A | 4/1987 | Takeda et al. |
| 4,664,254 | A | 5/1987 | Sitwell et al. |
| 4,685,571 | A | 8/1987 | Hoss |
| 4,700,832 | A | 10/1987 | Champ |
| 4,703,161 | A | 10/1987 | McLean |
| 4,707,883 | A | 11/1987 | Irani et al. |
| 4,722,376 | A | 2/1988 | Rhyner |
| 4,735,320 | A | 4/1988 | Hoss |
| D297,187 | S | 8/1988 | Kaczmarek |
| 4,762,227 | A | 8/1988 | Patterson |
| 4,817,769 | A | 4/1989 | Saliba |
| 4,828,081 | A | 5/1989 | Nordstrom et al. |
| 4,837,590 | A | 6/1989 | Sprague |
| 4,854,732 | A | 8/1989 | Italici |
| 4,874,093 | A | 10/1989 | Pharo |
| 4,901,897 | A | 2/1990 | Briggs et al. |
| 4,907,633 | A | 3/1990 | Eckstein |
| 4,919,240 | A | 4/1990 | Tobias |
| 4,946,036 | A | 8/1990 | Kupersmith |
| 4,991,328 | A | 2/1991 | Rousseau et al. |
| 5,010,988 | A | 4/1991 | Brown |
| 5,024,328 | A | 6/1991 | Bontrager |
| 5,031,763 | A | 7/1991 | Lynam |
| 5,056,665 | A | 10/1991 | Boeker et al. |
| 5,105,338 | A | 4/1992 | Held |
| 5,105,920 | A | 4/1992 | Grebenstein |
| 5,128,829 | A | 7/1992 | Loew |
| 5,129,519 | A | 7/1992 | David et al. |
| 5,150,776 | A | 9/1992 | Rebenack |
| 5,160,001 | A | 11/1992 | Marceau |
| 5,165,649 | A * | 11/1992 | Neumann et al. ..... 248/459 |
| 5,207,327 | A | 5/1993 | Brondos |
| 5,210,904 | A | 5/1993 | Pratt |
| 5,211,290 | A | 5/1993 | Janus et al. |
| 5,217,119 | A | 6/1993 | Hollingsworth |
| 5,221,005 | A | 6/1993 | Hayward |
| 5,226,542 | A | 7/1993 | Boecker et al. |
| 5,249,653 | A | 10/1993 | King |
| 5,251,102 | A | 10/1993 | Kimble |
| 5,330,049 | A | 7/1994 | Bertelsen et al. |
| 5,341,929 | A | 8/1994 | Stefancin, Jr. |
| 5,348,347 | A | 9/1994 | Shink |
| 5,356,004 | A | 10/1994 | Weinreb |
| 5,402,892 | A | 4/1995 | Jaszai |
| 2,708,989 | A | 5/1995 | Bogdanski |
| 5,445,266 | A | 8/1995 | Prete et al. |
| 5,469,945 | A | 11/1995 | Jserng |
| 5,494,157 | A | 2/1996 | Golenz et al. |
| 5,524,754 | A | 6/1996 | Hollingsworth |
| 5,544,792 | A | 8/1996 | Arnwine |
| 5,555,157 | A | 9/1996 | Moller et al. |
| 5,555,960 | A | 9/1996 | Bartsch |
| 5,594,619 | A | 1/1997 | Miyagawa et al. |
| 5,607,054 | A | 3/1997 | Hollingsworth |
| 5,622,262 | A | 4/1997 | Sadow |
| 5,624,035 | A | 4/1997 | Kim |
| 5,676,223 | A | 10/1997 | Cunningham |
| 5,676,509 | A | 10/1997 | Enzu |
| 5,678,666 | A | 10/1997 | Shyr et al. |
| 5,706,935 | A | 1/1998 | Lorton |
| 5,725,090 | A | 3/1998 | Vermillion et al. |
| 5,755,329 | A | 5/1998 | Sadow |
| 5,762,170 | A | 6/1998 | Shyr et al. |
| 5,765,688 | A | 6/1998 | Bertram et al. |
| 5,769,221 | A | 6/1998 | Cyr |
| 5,769,231 | A | 6/1998 | Batsford |
| 5,769,232 | A | 6/1998 | Cash et al. |
| 5,775,496 | A | 7/1998 | Cyr |
| 5,775,497 | A | 7/1998 | Krulik |
| 5,788,032 | A | 8/1998 | Krulik |
| 5,797,044 | A | 8/1998 | Lawther et al. |
| 5,808,865 | A | 9/1998 | Alves |
| 5,819,942 | A | 10/1998 | Sadow |
| 5,826,770 | A | 10/1998 | Chuang |
| 5,829,099 | A | 11/1998 | Kopelman et al. |
| 5,833,352 | A | 11/1998 | Goodwin |
| D403,151 | S | 12/1998 | Heredos-Formby |
| 5,857,568 | A | 1/1999 | Speirs |
| 5,881,850 | A | 3/1999 | Murdoch |
| 5,884,768 | A | 3/1999 | Fox |
| 5,887,723 | A | 3/1999 | Myles et al. |
| 5,887,777 | A | 3/1999 | Myles et al. |
| 5,908,147 | A | 6/1999 | Chuang |
| 5,909,759 | A | 6/1999 | Tanaka et al. |
| 5,909,806 | A | 6/1999 | Fischel et al. |

(56) References Cited

U.S. PATENT DOCUMENTS 5,954,170 A 9/1999 Chisholm
5,960,952 A 10/1999 Chen
5,967,270 A 10/1999 Shyr
5,971,148 A 10/1999 Jackson
5,996,180 A 12/1999 Eisenzopf
6,024,054 A 2/2000 Matt et al.
6,059,079 A 5/2000 Krulik
6,062,356 A 5/2000 Nykoluk
6,062,357 A 5/2000 Bogert
6,073,770 A 6/2000 Park
6,082,543 A 7/2000 Béliveau
6,098,768 A 8/2000 Tsai
6,105,763 A 8/2000 Saetia
6,105,764 A 8/2000 Scicluna et al.
6,105,766 A 8/2000 Chuang
6,109,434 A 8/2000 Howard, Jr.
6,131,734 A 10/2000 Hollingsworth et al.
6,145,337 A 11/2000 Wilson
6,145,661 A 11/2000 Jung
6,173,933 B1 1/2001 Whiteside et al.
6,179,431 B1 1/2001 Chien
6,193,118 B1 2/2001 Kearl
6,213,266 B1 4/2001 Hollingsworth
6,213,267 B1 4/2001 Miller
6,227,339 B1 5/2001 Bogert
6,237,766 B1 5/2001 Hollingsworth
6,257,407 B1 7/2001 Truwit et al.
6,286,645 B1 9/2001 Chen
6,295,650 B1 10/2001 Baacke
6,318,552 B1 11/2001 Godshaw
6,334,533 B1 1/2002 Hollingsworth et al.
6,334,534 B1 1/2002 Hollingsworth et al.
6,338,180 B1 1/2002 Massard
6,354,477 B1 3/2002 Trummer
6,360,402 B1 3/2002 Crabtree
6,390,297 B1 5/2002 Hollingsworth
6,439,389 B1 8/2002 Mogil
6,499,187 B2 12/2002 Hollingsworth et al.
6,535,199 B1 3/2003 Canova, Jr. et al.
D476,149 S 6/2003 Andre et al.
6,629,588 B2 10/2003 Nykoluk et al.
6,687,955 B2 2/2004 Hollingsworth
6,746,638 B1 6/2004 Zadesky et al.
6,772,879 B1 8/2004 Domotor
6,785,566 B1 8/2004 Irizarry
D500,923 S 1/2005 Gonzalez
6,925,739 B1 8/2005 Cole et al.
7,048,103 B2 5/2006 Hollingsworth
D527,176 S 8/2006 Andre et al.
D529,717 S 10/2006 Brancky
D533,348 S 12/2006 Andre et al.
7,207,154 B2 4/2007 Araujo
D541,646 S 5/2007 Hayes et al.
7,216,763 B2 5/2007 Gormick et al.
7,281,698 B2 10/2007 Patterson, Jr.
D574,375 S 8/2008 Prest et al.
D574,819 S 8/2008 Andre et al.
7,414,833 B2 8/2008 Kittayapong
7,451,872 B1 11/2008 Allen
D582,405 S 12/2008 Andre et al.
7,467,695 B2 12/2008 Gormick et al.
7,495,895 B2 2/2009 Carnevali
7,500,561 B2 3/2009 Matias et al.
7,503,440 B2 3/2009 Gormick et al.
7,735,644 B2 6/2010 Sirichai et al.
7,747,007 B2 6/2010 Hyun et al.
D623,404 S 9/2010 Andre et al.
D623,638 S 9/2010 Richardson et al.
D623,639 S 9/2010 Richardson et al.
7,876,550 B1 1/2011 Albertini et al.
8,016,107 B2 * 9/2011 Emsky ..... 206/320
8,051,980 B2 11/2011 Tai et al.
8,132,670 B1 * 3/2012 Chen ..... 206/320
D658,363 S 5/2012 Biddle
8,173,893 B2 5/2012 Huang
8,201,687 B2 * 6/2012 Zeliff et al. ..... 206/320
8,230,992 B2 7/2012 Law et al.
8,235,208 B2 8/2012 Sirichai et al.
8,253,518 B2 8/2012 Lauder et al.
8,281,924 B2 10/2012 Westrup
8,281,950 B2 10/2012 Potts et al.
8,312,991 B2 11/2012 Diebel et al.
8,328,008 B2 12/2012 Diebel et al.
D675,625 S 2/2013 Hasbrook et al.
8,393,464 B2 3/2013 Yang et al.
8,395,465 B2 3/2013 Lauder et al.
8,459,453 B2 6/2013 Parker et al.
8,467,183 B2 6/2013 Probst et al.
8,474,609 B1 7/2013 Hong et al.
8,542,480 B2 9/2013 Williams et al.
8,544,639 B2 10/2013 Yang et al.
8,573,394 B2 11/2013 Ahee et al.
8,584,847 B2 11/2013 Tages et al.
D696,253 S 12/2013 Akana et al.
D696,670 S 12/2013 Schiller et al.
2001/0014010 A1 8/2001 Jenks et al.
2001/0042665 A1 11/2001 Siwak
2001/0052710 A1 12/2001 Witherell
2002/0000390 A1 1/2002 Hollingsworth
2002/0027052 A1 3/2002 Godshaw et al.
2002/0179470 A1 12/2002 Lee
2003/0042091 A1 3/2003 Oh
2003/0132132 A1 7/2003 Small
2003/0183679 A1 10/2003 Ong
2003/0186729 A1 10/2003 Engstrom et al.
2004/0018863 A1 1/2004 Engstrom et al.
2004/0224732 A1 11/2004 Lee et al.
2004/0226793 A1 11/2004 Tilby
2004/0240164 A1 12/2004 Lee
2005/0057893 A1 3/2005 Homer et al.
2005/0237701 A1 10/2005 Yu
2006/0052064 A1 3/2006 Goradesky
2007/0001079 A1 1/2007 Patterson, Jr.
2007/0051645 A1 3/2007 Hassett
2007/0056865 A1 3/2007 Pelo
2007/0057140 A1 3/2007 Liou et al.
2007/0119734 A1 5/2007 Pichahchi
2007/0166028 A1 7/2007 Kranz et al.
2007/0205122 A1 9/2007 Oda et al.
2007/0279855 A1 12/2007 Linsmeier et al.
2008/0037213 A1 2/2008 Haren
2008/0043411 A1 2/2008 Chih et al.
2008/0045279 A1 2/2008 Ohki
2008/0055835 A1 3/2008 Kumano et al.
2008/0226286 A1 9/2008 Huang
2008/0237432 A1 10/2008 Patterson
2008/0251339 A1 10/2008 Williams
2009/0109558 A1 4/2009 Schaefer
2009/0127423 A1 5/2009 Chen et al.
2009/0139814 A1 6/2009 Grossman et al.
2009/0178938 A1 7/2009 Palmer
2009/0194209 A1 8/2009 DeFilippis et al.
2009/0205985 A1 8/2009 Freeman et al.
2009/0223765 A1 9/2009 Bosma
2009/0223845 A1 9/2009 Bosma et al.
2009/0229936 A1 9/2009 Cuong et al.
2009/0230006 A1 9/2009 Pidgley et al.
2009/0238335 A1 9/2009 Ripp et al.
2009/0294235 A1 12/2009 Santy et al.
2010/0072334 A1 3/2010 Le Gette et al.
2010/0082445 A1 4/2010 Hodge et al.
2010/0116710 A1 * 5/2010 Huang et al. ..... 206/759
2010/0225429 A1 9/2010 Tsai
2010/0258602 A1 10/2010 Amin
2011/0034221 A1 2/2011 Hung et al.
2011/0090626 A1 4/2011 Hoellwarth et al.
2011/0221319 A1 9/2011 Law et al.
2011/0284420 A1 11/2011 Sajid
2011/0290687 A1 12/2011 Han
2011/0297566 A1 12/2011 Gallagher et al.
2011/0297581 A1 12/2011 Angel
2011/0298345 A1 12/2011 Shortt et al.
2011/0315579 A1 12/2011 Mase
2011/0315589 A1 12/2011 Thomas

(56) References Cited

U.S. PATENT DOCUMENTS

| | | | | |
|---|---|---|---|---|
| 2012/0012483 | A1 | 1/2012 | Fan | |
| 2012/0024918 | A1 | 2/2012 | DeCamp et al. | |
| 2012/0075789 | A1 | 3/2012 | DeCamp et al. | |
| 2012/0112031 | A1 | 5/2012 | Gormick et al. | |
| 2012/0176741 | A1 | 7/2012 | Wu et al. | |
| 2012/0217174 | A1 | 8/2012 | Ting | |
| 2012/0298394 | A1 | 11/2012 | Huang | |
| 2012/0325702 | A1 | 12/2012 | Gallagher et al. | |
| 2013/0016467 | A1 | 1/2013 | Ku | |
| 2013/0045782 | A1 | 2/2013 | Simmer | |
| 2013/0048413 | A1 | 2/2013 | Patzer | |
| 2013/0048514 | A1 | 2/2013 | Corcoran et al. | |
| 2013/0063873 | A1 | 3/2013 | Wodrich et al. | |
| 2013/0126365 | A1* | 5/2013 | Hung | 206/45.24 |
| 2013/0163980 | A1 | 6/2013 | Lazaridis et al. | |
| 2013/0170686 | A1 | 7/2013 | Lester, Jr. | |
| 2013/0213838 | A1 | 8/2013 | Tsai et al. | |
| 2013/0214661 | A1 | 8/2013 | McBroom | |
| 2013/0241381 | A1 | 9/2013 | Hynecek et al. | |
| 2013/0264459 | A1 | 10/2013 | McCosh et al. | |
| 2013/0271922 | A1 | 10/2013 | Wilson et al. | |
| 2013/0322660 | A1 | 12/2013 | Weiss | |

FOREIGN PATENT DOCUMENTS

| | | | |
|---|---|---|---|
| CA | 2 827 491 | A1 | 9/2012 |
| DE | 4234581 | | 4/1993 |
| EP | 797939 | A2 | 1/1997 |
| EP | 797939 | A3 | 7/1998 |
| EP | 1 548 544 | A2 | 6/2005 |
| EP | 2 392 986 | A2 | 12/2011 |
| EP | 2 426 571 | A2 | 3/2012 |
| EP | 2 564 722 | A1 | 3/2013 |
| EP | 2 638 823 | A1 | 9/2013 |
| EP | 2 337 373 | B1 | 12/2013 |
| FR | 2391668 | A | 12/1978 |
| GB | 146601 | | 7/1920 |
| GB | 161117 | | 4/1921 |
| GB | 2 402 869 | A | 12/2004 |
| GB | 2495330 | A | 4/2013 |
| GB | 2496109 | A | 5/2013 |
| JP | 135796 | | 11/1978 |
| JP | 3222728 | | 10/1991 |
| JP | H073344 | U | 1/1995 |
| JP | 09135722 | A | 5/1997 |
| JP | 11299521 | A | 11/1999 |
| JP | 2000014426 | A | 1/2000 |
| JP | 2000217622 | A | 8/2000 |
| JP | 2004509680 | A | 4/2004 |
| JP | 2004231158 | A | 8/2004 |
| KR | 100362369 | B1 | 11/2002 |
| KR | 10-1264668 | B1 | 5/2013 |
| KR | 10-2013-0081622 | | 11/2013 |
| MY | WO 2010/036090 | A2 | 4/2010 |
| SU | 1638073 | | 3/1991 |
| WO | WO 01/90848 | A2 | 11/2001 |
| WO | WO 2011/115918 | A1 | 9/2011 |
| WO | WO 2011/130157 | A2 | 10/2011 |
| WO | WO 2012/112790 | A2 | 8/2012 |
| WO | WO 2013/058938 | A1 | 4/2013 |
| WO | WO 2013/096633 | A1 | 6/2013 |
| WO | WO 2013/103928 | A1 | 7/2013 |
| WO | WO 2013/126216 | A1 | 8/2013 |
| WO | WO 2013/128675 | A1 | 9/2013 |
| WO | WO 2013/188319 | A1 | 12/2013 |

OTHER PUBLICATIONS

Office Action for U.S. Appl. No. 12/370,824, filed Feb. 13, 2009, and mailed from the USPTO on May 20, 2013, 22 pgs.

Notice of Allowance and Fee(s) Due for U.S. Appl. No. 12/370,824, filed Feb. 13, 2009, and mailed from the USPTO on Sep. 9, 2013, 12 pgs.

Office Action for U.S. Appl. No. 13/285,565, filed Oct. 31, 2011, and mailed from the USPTO on May 9, 2013, 11 pgs.

Office Action for U.S. Appl. No. 13/171,225, filed Jun. 28, 2011, and mailed from the USPTO on Apr. 16, 2013, 24 pgs.

MacWorld, "PortTM: the best cradle for your powerbook," Apr. 1993.

Office Action for U.S. Appl. No. 10/939,333, filed Sep. 14, 2004, mailed Apr. 7, 2008 15 pgs.

Office Action for U.S. Appl. No. 10/939,346, filed Sep. 14, 2004, mailed Apr. 8, 2008 14 pgs.

Office Action for U.S. Appl. No. 13/308,192, filed Nov. 30, 2011, and mailed Mar. 23, 2012 14 pgs.

Office Action for U.S. Appl. No. 13/308,192, filed Nov. 30, 2011, and mailed Aug. 27, 2012 14 pgs.

Office Action for U.S. Appl. No. 12/370,824, filed Feb. 13, 2009, mailed Aug. 2, 2012 16 pgs.

Office Action U.S. Appl. No. 12/370,824, filed Feb. 13, 2009, and mailed Jan. 4, 2013, (19 pgs.).

Non-Final Office Action for U.S. Appl. No. 13/791,445, filed Mar. 8, 2013, and mailed from the USPTO on Dec. 27, 2013, 8 pgs.

Office Action for U.S. Appl. No. 13/739,846, filed Jan. 11, 2013, mailed Feb. 27, 2014, 19 pgs.

Final Office Action for U.S. Appl. No. 13/171,225, filed Jun. 28, 2011, and mailed from the USPTO on Dec. 4, 2013, 17 pgs.

Notice of Allowance and Fee(s) Due for U.S. Appl. No. 29/431,992, filed Sep. 12, 2012, and mailed from the USPTO on Apr. 2, 2014, 27 pgs.

Non-final Office Action for U.S. Appl. No. 14/099,436, filed Dec. 6, 2013, and mailed from the USPTO on Mar. 26, 2014, 18 pgs.

* cited by examiner

DUAL SUPPORT FLAP CASE

TECHNICAL FIELD

The present invention relates, generally, to cases and accessories for portable electronic devices.

BACKGROUND

Advances in mobile computing have led to consumer adoption of portable electronic devices. However, due to the portability of these devices, they are susceptible to damage from physical impact and exposure to the elements. For this reason cases and accessories for portable electronic devices have been designed to minimize the damage to these devices.

SUMMARY

Embodiments of the present disclosure provide an accessory case for a portable electronic device, the case being configured to protect the portable electronic device from damage. In some embodiments, the accessory case securely retains the portable electronic device. In various embodiments, the case may be configured in a closed position, in an open position, and in a plurality of supported (i.e., propped up) positions.

Generally, the case comprises two support panels or flaps configured to support the case in a first supported (i.e., elevated) position and a second supported (i.e., elevated) position. These support flaps allow the case to be arranged at different angles with respect to a supporting surface. The first and second supported positions allow the user to choose at least two different angles at which to view a portable electronic device that has been placed inside the case. The user may selectively arrange the case at a viewing angle best suited for a particular task (e.g., typing, gaming, viewing media) or for a particular surface (e.g., whether the case rests on a flat surface or an angled surface).

In some embodiments, the case may be selectively arranged so that the screen of the personal electronic device is at a portrait orientation or at a landscape orientation.

Additional aspects and advantages will be apparent from the following detailed description of preferred embodiments, which proceeds with reference to the accompanying drawings.

BRIEF DESCRIPTION OF THE DRAWINGS

Non-limiting and non-exhaustive embodiments of the disclosure are described, including various embodiments of the disclosure with reference to the figures, in which.

DETAILED DESCRIPTION OF PREFERRED EMBODIMENTS

Figure 1A:
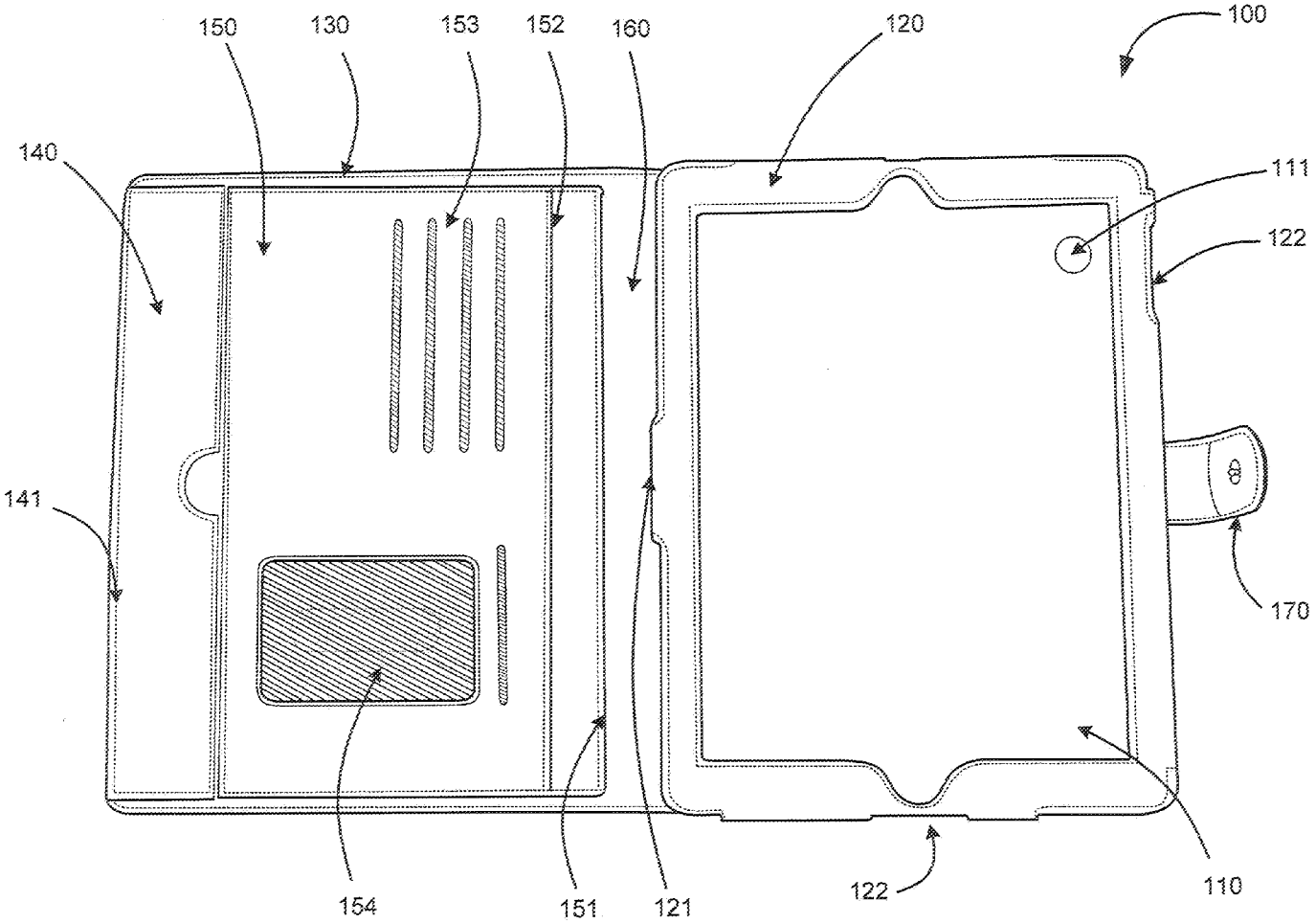
FIG. 1A depicts one embodiment of a case arranged in a first open configuration.

Portable electronic devices provide users with mobile computing. Mobile computing enhances personal activity and business productivity. Portable electronic devices include laptop computers, notebook computers, subnotebook computers, netbook computers, ultraportable computers (e.g., ultrabooks or slimbooks), ultra-mobile PCs, smartbook computers, tablet computers, smartphones, personal digital assistants, mobile internet devices, electronic reading devices, portable media players, digital cameras, and the like.

Portable electronic devices are generally more at risk to damage than traditional non-portable computing devices. As portable electronic devices are carried by users, there is a risk that these devices may be dropped or may collide with other objects. There is also risk that these devices will be scratched or otherwise marred when placed in pockets, purses, book bags, drawers, or the like. Accordingly, many users seek to protect their portable devices from harm by encasing their devices in protective cases. Protective cases not only protect against scratches, dents, and the like; they also protect against environmental damage such as degradation due to exposure to sunlight, dust, or other elements.

Embodiments of the present disclosure provide an accessory case for a portable electronic device, the case being configured to protect the portable electronic device from damage. In some embodiments, the accessory case securely retains the portable electronic device. In various embodiments, the accessory case comprises a bifold case that may be configured in a closed position, in an open position, and in a plurality of supported (i.e., raised) positions.

Generally, the case comprises two support panels or flaps configured to support the case in a first supported (i.e., elevated) position and a second supported (i.e., elevated) position. These support flaps allow the case to be arranged at different angles with respect to a supporting surface. The first and second supported or raised positions allow the user to choose at least two different angles at which to view a portable electronic device that has been placed inside the case.

The user may selectively arrange the case at a viewing angle best suited for a particular task (e.g., typing, gaming, viewing media) or for a particular surface (e.g., whether the case rests on a flat surface or an angled surface).

In some embodiments, the case may be selectively arranged so that the screen of the personal electronic device is at a portrait orientation or at a landscape orientation.

The embodiments of the disclosure may be better understood by reference to the drawings. Generally, like features are designated by like reference numerals. It will be readily understood that the components of the present disclosure, as generally described and depicted in the drawings herein, may be arranged and designated in a wide variety of different configurations. Further, the described features, elements, or characteristics may be combined in any suitable manner in one or more embodiments. Thus, the following more detailed description of the illustrated embodiments of the apparatus is not intended to limit the scope of the disclosure, but is merely representative of possible embodiments of the disclosure. In some instances, well-known structures, materials, or operations are not shown or described in detail.

Figure 1B:
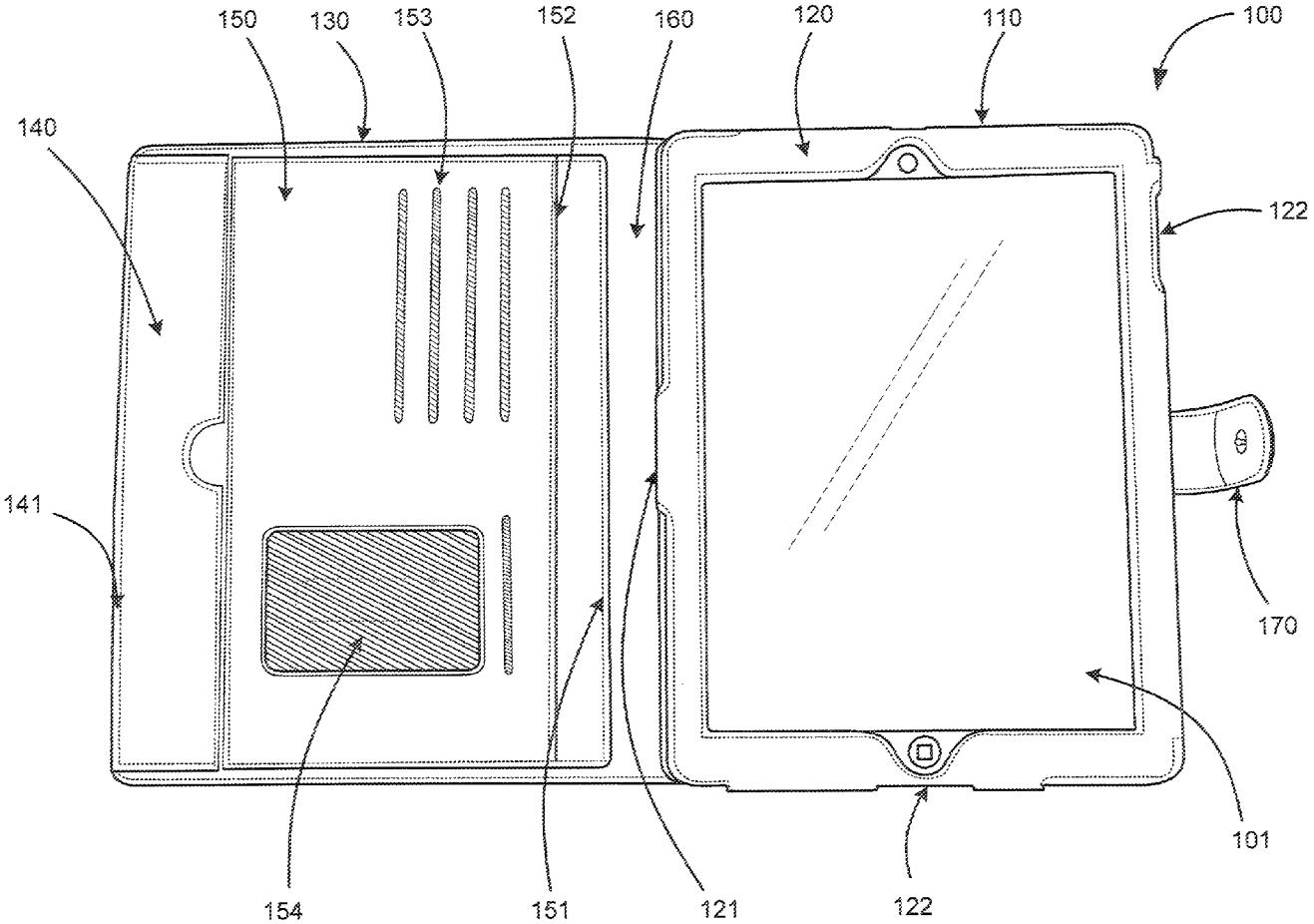
FIG. 1B depicts another embodiment of a case arranged in a first open configuration.
Figure 1C:
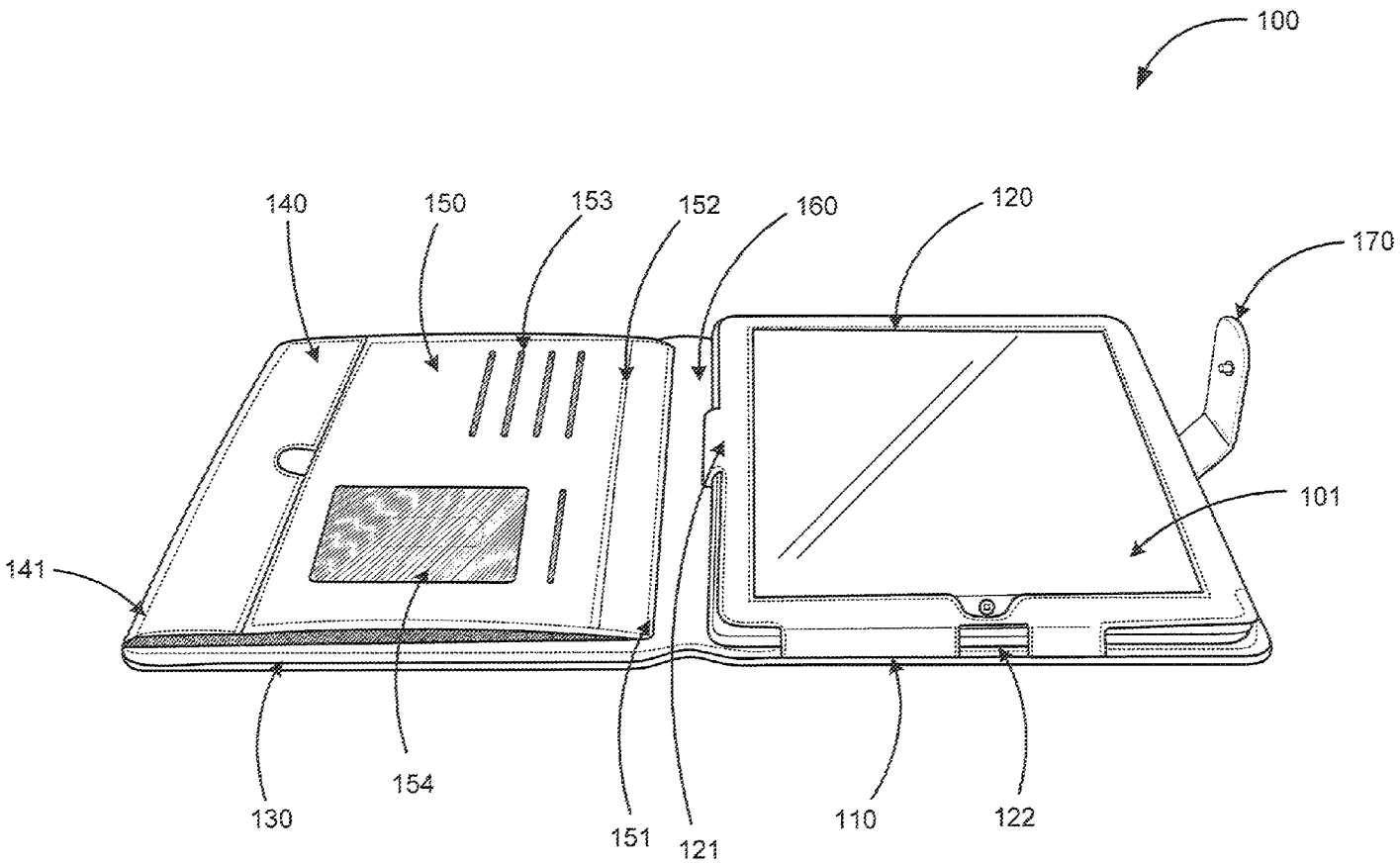
FIG. 1C depicts a perspective view of one embodiment of a case arranged in a first open configuration.

Referring to the drawings, FIGS. 1A-1C are views illustrating one embodiment of a bifold case 100 for a portable electronic device 101. The bifold case 100 includes a first panel 110 and a second panel 130 joined by a panel connector 160, a device receptacle 120 mounted on the first panel 110, a first support flap 140 mounted on the second panel 130, and a second support flap 150 mounted on the second panel 130. In some embodiments, the bifold case 100 further comprises a case closure 170. FIG. 1A is a top view of the bifold case 100 in a first opened position with first panel 110 and the second panel 130 extended to be approximately parallel. FIGS. 1B and 1C show a top view and a perspective view, respectively, of the bifold case 100 in the first opened position. The bifold case 100 is configured to selectively protect a portable electronic device 101 and to selectively support the portable electronic device 101 in one or more elevated positions. The first support flap 140 is configured to selectively support the bifold case 100 and/or the portable electronic device 101 in a first elevated position while the second support flap 150 is configured to selectively support the bifold case 100 and/or the portable electronic device 101 in a second elevated position.

In FIGS. 1B and 1C, a portable electronic device 101 has been placed in the device receptacle 120 of the bifold case 100 of FIG. 1A. The portable electronic device 101 may be any portable electronic device including, for example, a laptop computer, a notebook or subnotebook computer, a netbook computer, an ultraportable computer (e.g., a Intel® defined Ultrabook™), an ultra-mobile PC, a smartbook computer, a tablet computer, a smartphone, a personal digital assistant (PDA), a mobile internet device, an electronic reading device, a portable media player, a digital camera, and the like. As will be understood by one of skill in the art, various dimensions and/or proportions of the bifold case 100 may be modified to fit a specific portable electronic device 101. For example, a bifold case 100 for one type of portable electronic device 101 (e.g., an Apple® iPad™) may have different dimensions and/or proportions than a bifold case 100 for another type of portable electronic device 101 (e.g., an Apple® iPhone™).

The first panel 110 is a rectangular and planar panel that is approximately matched to the dimensions of a portable electronic device 101 and/or to the second panel 130. The first panel 110 provides support to the device receptacle 120 and to the portable electronic device. The first panel 110 also protects the back of the portable electronic device 101 when said portable electronic device 101 is inserted into the device receptacle 120. The shape and size of the first panel 110 may be configured to match the dimensions of a corresponding second panel 130 or of a portable electronic device 101. For example, the dimensions of the first panel 110 may substantially match that of a specific portable electronic device such as a specific tablet computer or smartphone. Thus, in other embodiments, the first panel 110 may have any other shape or size to match any available portable electronic device. In FIG. 1C, the first panel 110 is dimensioned to match the portable electronic device 101 such that the portable electronic device 101 fits snugly between the first panel 110 and the device receptacle 120. The first panel 110 is dimensioned to extend sufficiently beyond the edge of the portable electronic device 101 to protect the edge of the portable electronic device 101 in case the portable electronic device 101 falls, without being too bulky or unwieldy.

In some embodiments, the first panel 110 comprises a camera window 111. The camera window 111 is positioned in the first panel 110 to correspond with a position of a digital camera located on the back side of a portable electronic device 101 when placed within the device receptacle 120. In some embodiments, the camera window 111 comprises transparent material configured to allow light to pass through to a camera of the portable electronic device 101 while providing a barrier between the camera and objects or surfaces exterior to the case. In other embodiments, the camera window 111 comprises a hole or cutout in the material of the first panel 110 and does not provide a barrier between the camera and objects or surfaces exterior to the bifold case 100. As will be understood by one of skill in the art, various dimensions and/or proportions of the camera window 111 may be modified to fit a specific portable electronic device 101. In situation where a portable electronic device 101 comprises more than one camera, more than one camera windows may be provided in the first panel 110.

In some embodiments, the first panel 110 may be rigid or semi-rigid to maintain its shape when there is no portable electronic device present. In one embodiment, a rigid or semi-rigid first panel 110 may retain a planar shape when there is no portable electronic device in the device receptacle 120. Similarly, a rigid or semi-rigid first panel 110 may retain its shape to support the bifold case 100 and/or a portable electronic device 101 when the bifold case 100 is configured in an elevated or supported position. For example, if the first panel 110 is extremely flexible it may not hold its shape enough to support the bifold case 100 and/or portable electronic device 101 in the elevated or supported positions depicted in FIG. 4C or 5B.

The first panel 110 may be formed of a variety of materials including a fabric, leather, plastic, composite, metal, or any other material. In some embodiments, an inner surface portion of the first panel 110 may be formed of a soft or protective material to reduce scratching of a portable electronic device 101. For example, a surface of the first panel 110 adjacent to the device receptacle 120 may be formed of a soft fabric, lint free cloth, felt, suede leather or imitation suede leather, or the like. Other portions of the first panel 110 may include the same or other materials to provide a pleasing appearance to the bifold case 100. In some embodiments, the first panel 110 may be formed of rigid or semi-rigid material such that the first panel 110 maintains its planar shape. For example, the first panel 110 may be formed of a variety of rigid or semi-rigid materials including a fabric, leather, plastic, composite, metal, or any other suitable material. In some embodiments, an outer portion of the first panel 110 may be formed of a scratch-resistant material to reduce scratching of the bifold case 100. Other portions of the first panel 110 may include the same or other materials to provide a pleasing appearance to the bifold case 100. In some embodiments, the first panel 110 comprises shock absorptive material to protect against shock damage if the bifold case 100 containing the personal electronic device 101 is dropped. For example, a layer of padding may be formed at the interior of the first panel 110 to absorb the impact of a fall or drop. The padding may be formed of polymer, leather, fabric, felt, gel, foam, rubber, synthetic rubber, or other suitable shock absorptive material.

The device receptacle 120 attaches to the first panel 110 and is configured to receive and hold a portable electronic device 101. The device receptacle 120 has a shape corresponding to a portable electronic device 101 such that it encloses the portable electronic device 101 around its perimeter to retain the portable electronic device 101 to the bifold case 100. The shape and size of the device receptacle 120 may be configured to match the dimensions of the first panel 110 and/or of a portable electronic device 101. For example, the dimensions of the device receptacle 120 may substantially match that of a specific portable electronic device such as a specific tablet computer or smartphone. Thus, in other embodiments, the device receptacle 120 may have any other shape or size to match any available portable electronic device. The device receptacle 120 acts together with the first panel 110 to enclose and retain the portable electronic device 101 and protect it from damage. As shown in FIG. 1C, the device receptacle 120 may be dimensioned to match the portable electronic device 101 such that the portable electronic device 101 fits snugly between the first panel 110 and the device receptacle 120.

The first panel 110 and device receptacle 120 retain a portable electronic device 101 such that the backside and edges of the portable electronic device 101 are substantially protected. The second panel 130 covers a screen of a portable electronic device 101 when the bifold case 100 is in a closed position. Thus, the bifold case 100 shown in the embodiments of FIGS. 1A-1C may completely cover the back, sides, and front of a portable electronic device 101 when the bifold case 100 in a closed position (see, e.g., FIG. 3A). Other embodiments may not completely cover a back or the edges of a portable electronic device 101. For example, the device receptacle 120 may be replaced by an attachment mechanism that attaches to a portable electronic device 101 but does not cover the edges of the portable electronic device 101. One of skill in the art will recognize considerable variation within the scope of the present disclosure regarding how a bifold case 100 may be attached to a portable electronic device 101.

The device receptacle 120 comprises a window or opening configured to match the dimensions of a screen of the portable electronic device. The window allows a user to manipulate a touch screen and/or controls of the portable electronic device 101. For example, the device receptacle 120 may be sized and shaped to match a display bezel of portable electronic device 101 such that the entire display may be seen and/or manipulated through the device receptacle 120, but edges of the display (including the bezel) are protected. In some embodiments, the device receptacle 120 comprises a screen protector to prevent damage to a surface of the portable electronic device screen. In other embodiments, the device receptacle 120 window comprises a cutout or opening.

In some embodiments, device receptacle 120 comprises a device retainer 121 configured to retain a portable electronic device 101 when placed in the device receptacle 120. In some embodiments, the device retainer 121 extends from, or is permanently affixed to, the device receptacle 120 and selectively fastens to the first panel 110 thereby securing the portable electronic device 101 within the device receptacle 120. In other embodiments, the device retainer 121 extends from, or is permanently affixed to, the first panel 110 and selectively fastens to the device receptacle 121 to secure the portable electronic device 101. The device retainer 121 removably fastens to the first panel 110 (or device receptacle 120) using suitable fasteners, including, but not limited to, snap fasteners, hook-and-loop fasteners, hook-and-eye fasteners, magnets, buttons, buckles, zippers, ties, adhesives, retaining pins or clips, or the like.

Generally, the device receptacle 120 extends along the sides of the portable electronic device 101 to protect the sides from damage. However, in some embodiments, the device receptacle 120 comprises at least one access slot 122 configured to allow a user access to buttons, switches, ports, and/or slots located on a portable electronic device 101. The access slot(s) 122 are located at suitable positions on the device receptacle 120 to allow for user manipulation of the controls, ports, and/or slots of the portable electronic device 101. For example, access slots 122 may allow a user to actuate a volume switch, plug a data connector into a data port, and/or insert a removable memory device (e.g., an SD card) into a memory slot in the portable electronic device 101. FIGS. 1A and 1B illustrate two access slots 122 located at the right side and at the bottom of the device receptacle. FIG. 1B shows that the buttons of portable electronic device 101 do not extend beyond the device receptacle 120 and thus are protected by the device receptacle 120. In some embodiments, one or more access slots 122 are located on the device receptacle 120 corresponding to one or more speakers on the portable electronic device 101. As will be understood by one of skill in the art, the access slot(s) 122 of the bifold case 100 may be modified to accommodate the various locations and dimensions of buttons, switches, ports, slots, and/or speakers of a specific portable electronic device 101. Further, the number of access slots 122 provided in the device receptacle 120 may vary according to the number and location of buttons, switches, ports, slots, and/or speakers of a specific portable electronic device 101.

In some embodiments, the device receptacle 120 may be rigid or semi-rigid to maintain its shape when there is no portable electronic device present. Similarly, a rigid or semi-rigid device receptacle 120 may retain the portable electronic device 101 in a constant location respective to the first panel 110. For example, if the device receptacle 102 is extremely flexible it may not hold its shape enough to prevent a portable electronic device 101 from shifting around in the device receptacle 120. Such shifting may result in scratches to the display and/or body of the portable electronic device 101, thus a rigid or semi-rigid device receptacle 120 may prevent scratching of the portable electronic device 101. In other embodiments, the device receptacle 120 may be flexible to accommodate a variety of portable electronic devices 101 having varying dimensions.

The device receptacle 120 may be formed of a variety of materials including a fabric, leather, plastic, composite, metal, or any other material. In some embodiments, an inner portion of the device receptacle 120 may be formed of a soft or protective material to reduce scratching of a portable electronic device 101. For example, a surface of the device receptacle 120 in contact with the portable electronic device 101 may be formed of a soft fabric, lint free cloth, felt, suede leather or imitation suede leather, or the like. Other portions of the device receptacle 120 may include the same or other materials to provide a pleasing appearance to the bifold case 100. In some embodiments, an outer portion of the device receptacle 120 may be formed of rigid or semi-rigid material such that the device receptacle 120 maintains its shape when there is no portable electronic device within the device receptacle 120. For example, an outer portion of the device receptacle 120 may be formed of a variety of rigid or semi-rigid materials including a fabric, leather, plastic, composite, metal, or any other suitable material. Other portions of the device receptacle 120 may include the same or other materials to provide a pleasing appearance to the bifold case 100.

The second panel 130 is a rectangular and planar panel that is approximately matched to the dimensions of the first panel 110. The second panel 130 protects the screen of the portable electronic device 101 when the bifold case 100 is arranged in a closed position. The second panel 130 provides support to the first support flap 140 and the second support flap 150. In some embodiments, the first support flap 140 attaches to a first portion of the second panel 130 and the second support flap 150 attaches to a second portion of the second panel 130. In some embodiments, the second panel 130, the first support flap 140, and the second support flap 150 are formed from a single, contiguous piece of material. Constructing these elements from a contiguous piece of material beneficially enhances the strength of the bifold case 100 (i.e., allows the bifold case 100 to support a greater weight), increases durability (e.g., reduces the likelihood that the bifold case 100 will come apart at the joint between the second panel 130 and the first support flap 140), and reduces cost.

As discussed above, the shape and size of the first panel 110 (and consequently, the second panel 130) may be configured to match the dimensions of a portable electronic device 101. In some embodiments, the dimensions of the second panel 130 substantially match that of a specific portable electronic device 101. In other embodiments, the second panel 130 may have any other shape or size to match any available portable electronic device.

As shown in FIG. 1A, the first support flap 140 and the second support flap 150 attach to the second panel 130 such that the first support flap 140 and the second support flap 150 may rotate with respect to the second panel 130. The axis of rotation of the first support flap 140 is parallel (or substantially parallel) to the axis of rotation of the second support flap 150.

In some embodiments, the second panel 130 may be rigid or semi-rigid to maintain its shape. In one embodiment, a rigid or semi-rigid second panel 130 may retain its planar shape when supporting the bifold case 100 and/or portable electronic device 101 in an elevated or supported position. For example, if the second panel 130 is extremely flexible it may not hold its shape enough to support the bifold case 100 and/or portable electronic device 101 in the elevated or supported positions depicted in FIG. 4C or 5B.

The second panel may be formed of a variety of materials including a fabric, leather, plastic, composite, metal, or any other material. In some embodiments, the second panel may be formed of rigid or semi-rigid material such that the second panel maintains its planar shape. For example, the second panel may be formed of a variety of rigid or semi-rigid materials including a fabric, leather, plastic, composite, metal, or any other suitable material. In some embodiments, an outer portion of the second panel may be formed of a scratch-resistant material to reduce scratching of the case. Other portions of the second panel may include the same or other materials to provide a pleasing appearance to the bifold case 100. In some embodiments, the second panel comprises shock absorptive material to protect the personal electronic device against shock damage if the case is dropped. For example, a layer of padding may be formed at the interior of the second panel to absorb the impact of a fall or drop. The padding may be formed of polymer, leather, fabric, felt, gel, foam, rubber, synthetic rubber, or other suitable shock absorptive material.

Figure 4A:
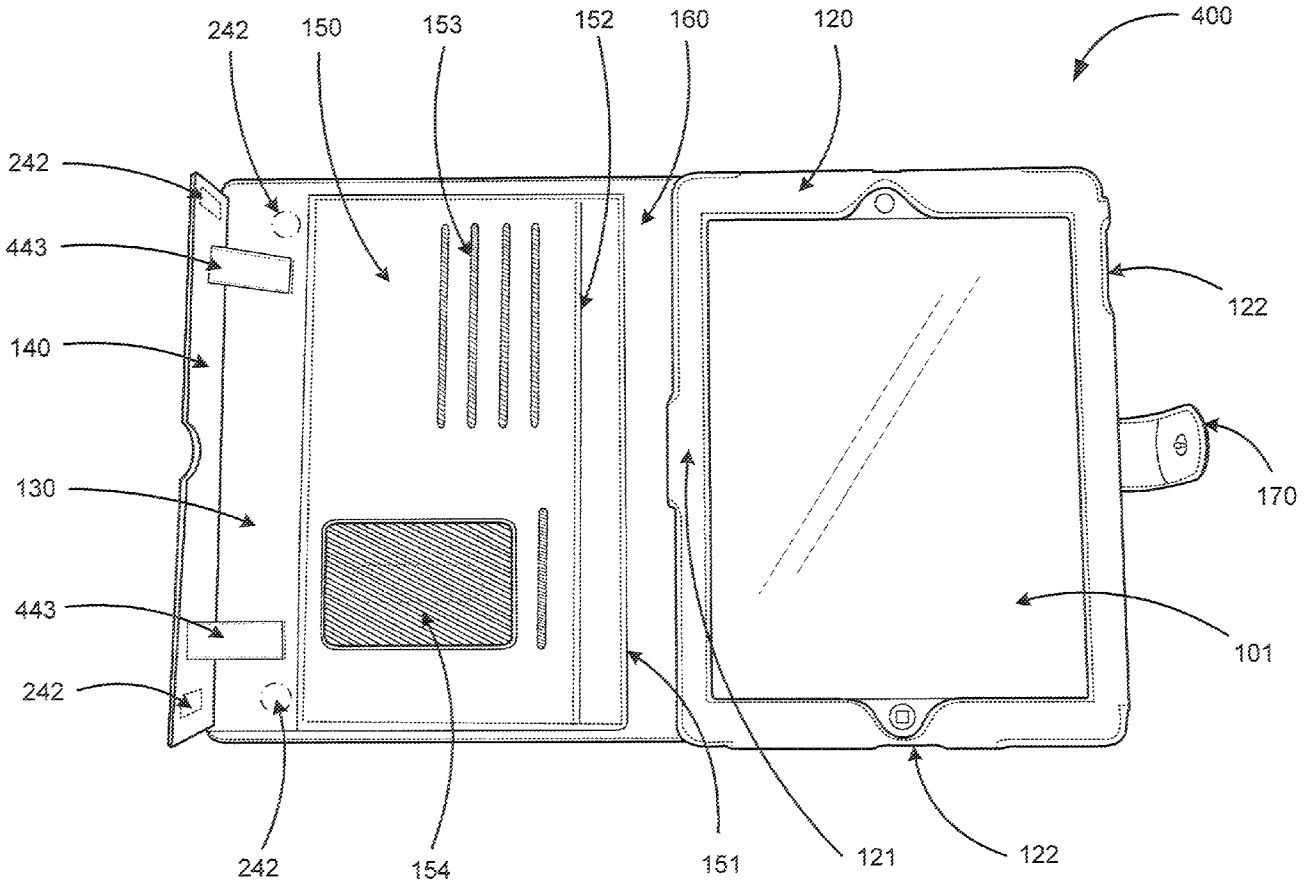
FIG. 4A depicts another embodiment of a case arranged in a first open configuration.
Figure 4B:
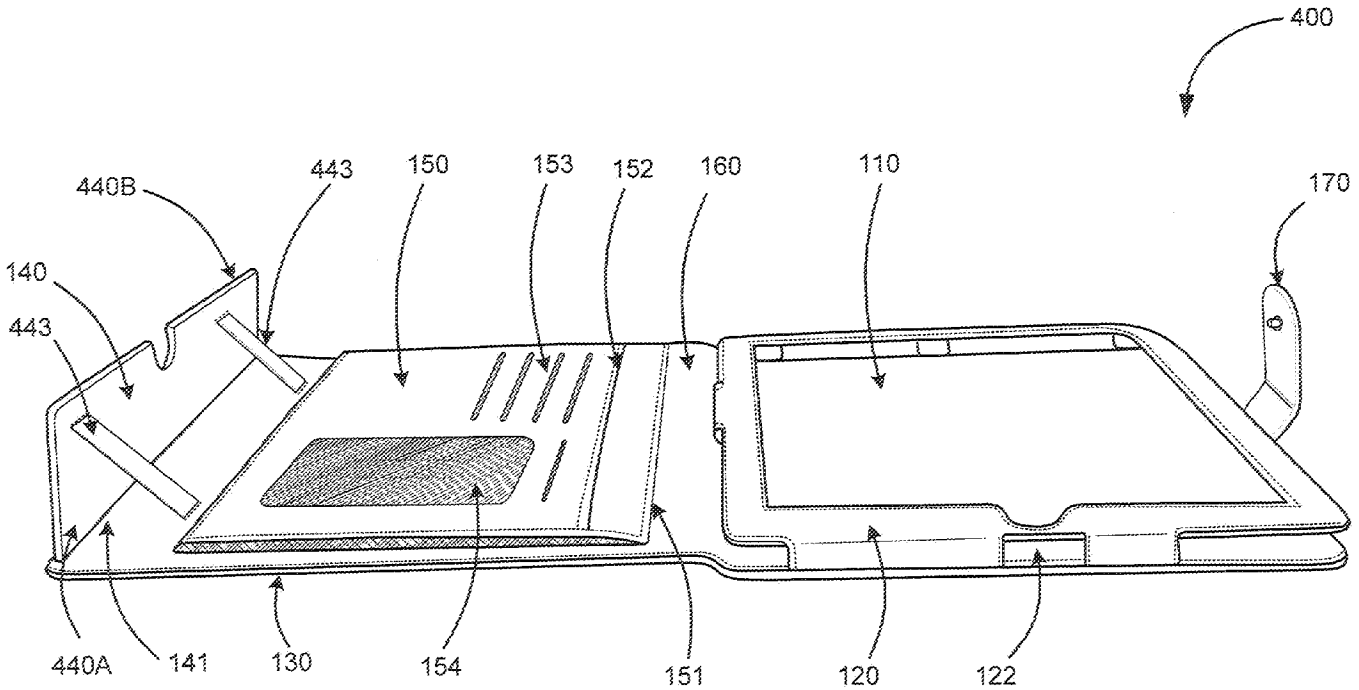
FIG. 4B depicts a perspective view of another embodiment of a case arranged in a first open configuration.
Figure 4C:
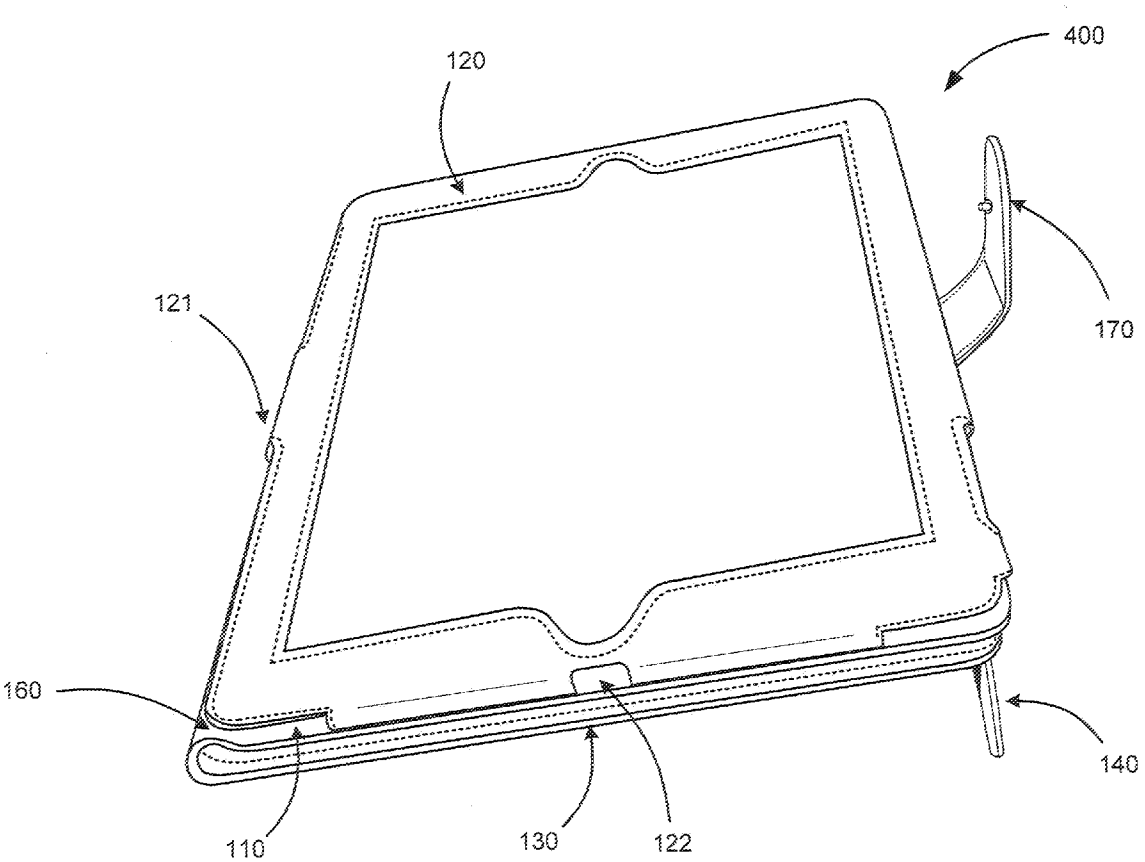
FIG. 4C depicts a perspective view of one embodiment of a case arranged in a second open configuration and in a first supported position.
Figure 4D:
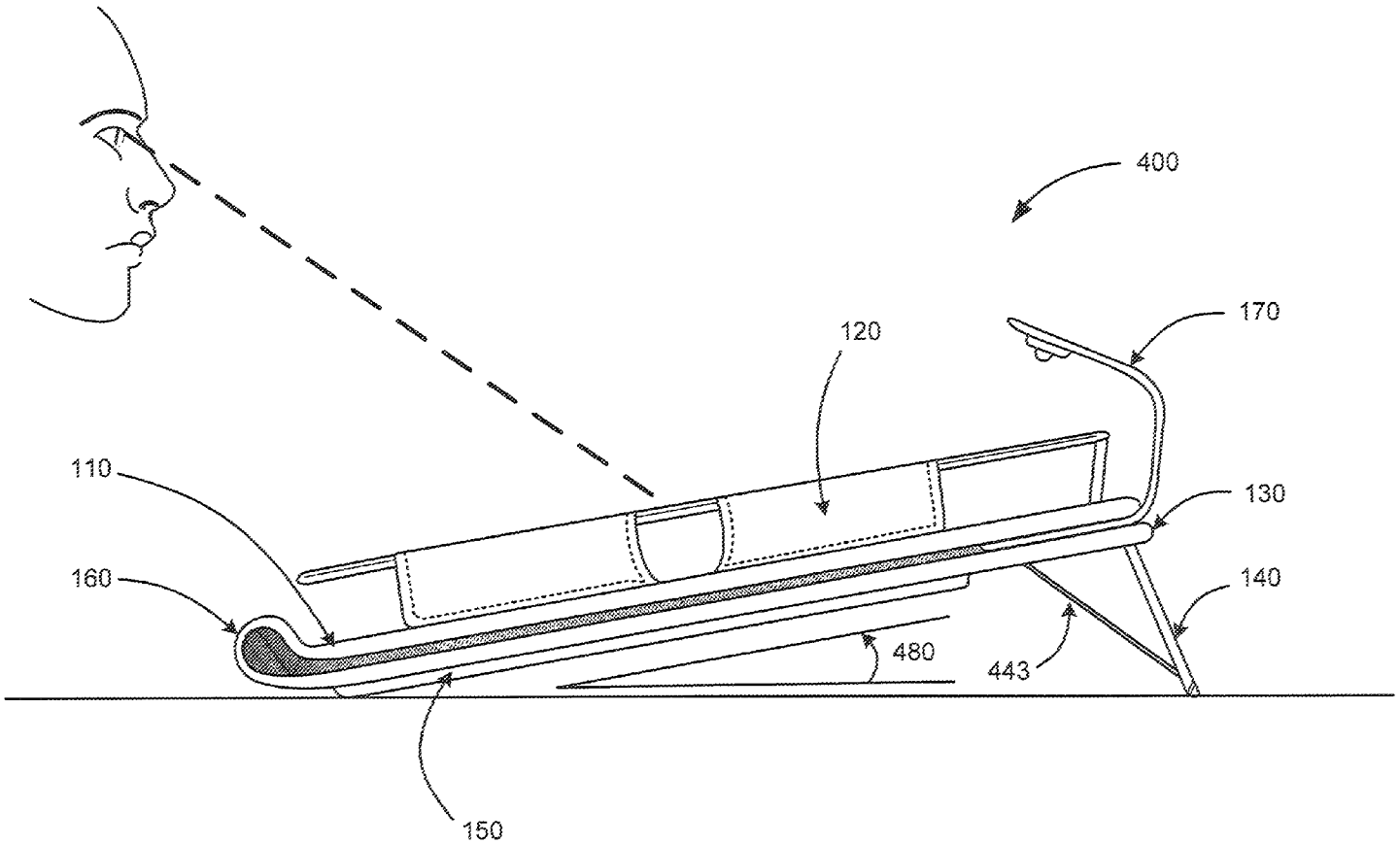
FIG. 4D depicts a side view of one embodiment of a case arranged in a second open configuration and in a first supported position.

The first support flap 140 is a rectangular and planar flap that may be used to raise one end of the case into a first supported position as shown in FIGS. 4C and 4D. The first supported position places a screen of the personal electronic device 101 at a first angle relative to the surface upon which the case rests. The first support flap 140 is attached to a first portion of the second panel 130 via a first flap connector 141. The first flap connector 141 may comprise a flexible joint, a mechanical hinge, or any other suitable connector. For example, the first flap connector 141 may be made from a fabric, leather, a hinge, or another material or mechanism such that the first support flap 140 and the second panel 130 can pivot in relation to each other. The first support flap 140 may be free or selectively freed to pivot away from the second panel 130 to allow the second support flap to be extended.

The first support flap 140 can be arranged in a folded position and an extended position. When in the folded position, the first support flap 140 lies flat against the second panel 130. To transition to the extended position, the first support flap 140 is rotated away from the second panel 130 to a maximum rotation angle. In some embodiments, the first support flap 140 may comprise one or more first rotation limiters configured to restrict the amount by which the first support flap 140 can rotate. Embodiments of the first rotation limiter(s) will be discussed in detail below with reference to FIGS. 4A-4D.

In some embodiments, the first support flap 140 may be rigid or semi-rigid to maintain its shape. In one embodiment, a rigid or semi-rigid first support flap 140 retains its planar shape to support the bifold case 100 and/or second panel 130 when the bifold case 100 is configured in an elevated or supported position. For example, if the first support flap 140 is extremely flexible it may not hold its shape enough to support the bifold case 100 and/or portable electronic device 101 in the elevated or supported positions depicted in FIG. 4C or 5B.

The first support flap 140 may be formed of a variety of materials including a fabric, leather, plastic, composite, metal, or any other material. In some embodiments, an outer portion of the first support flap 140 may be formed of a soft or protective material to reduce scratching of a portable electronic device 101. For example, a surface of the first support flap 140 that faces the device receptacle when the bifold case 100 is arranged in a closed configuration may be formed of a soft fabric, lint free cloth, suede leather or imitation suede leather, or the like. Other portions of the first support flap 140 may include the same or other materials to provide a pleasing appearance to the bifold case 100. In some embodiments, the first support flap 140 may be formed of rigid or semi-rigid material such that the first support flap 140 maintains its planar shape. For example, a portion of the first support flap 140 may be formed of a variety of rigid or semi-rigid materials including a fabric, leather, plastic, composite, metal, or any other suitable material. Other portions of the first support flap 140 may include the same or other materials to provide a pleasing appearance to the bifold case 100.

Figure 5A:
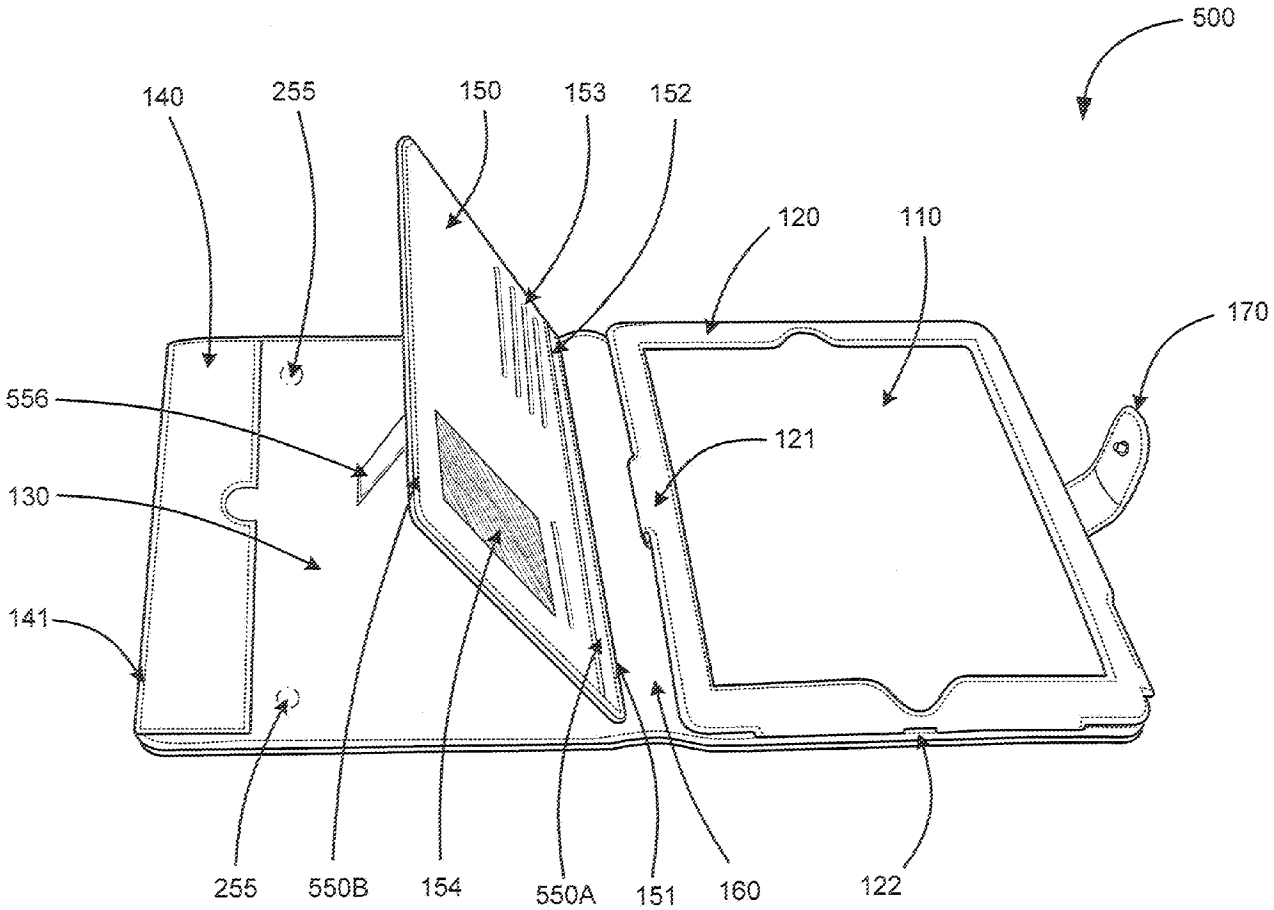
FIG. 5A depicts a perspective view of another embodiment of a case arranged in a first open configuration.
Figure 5B:
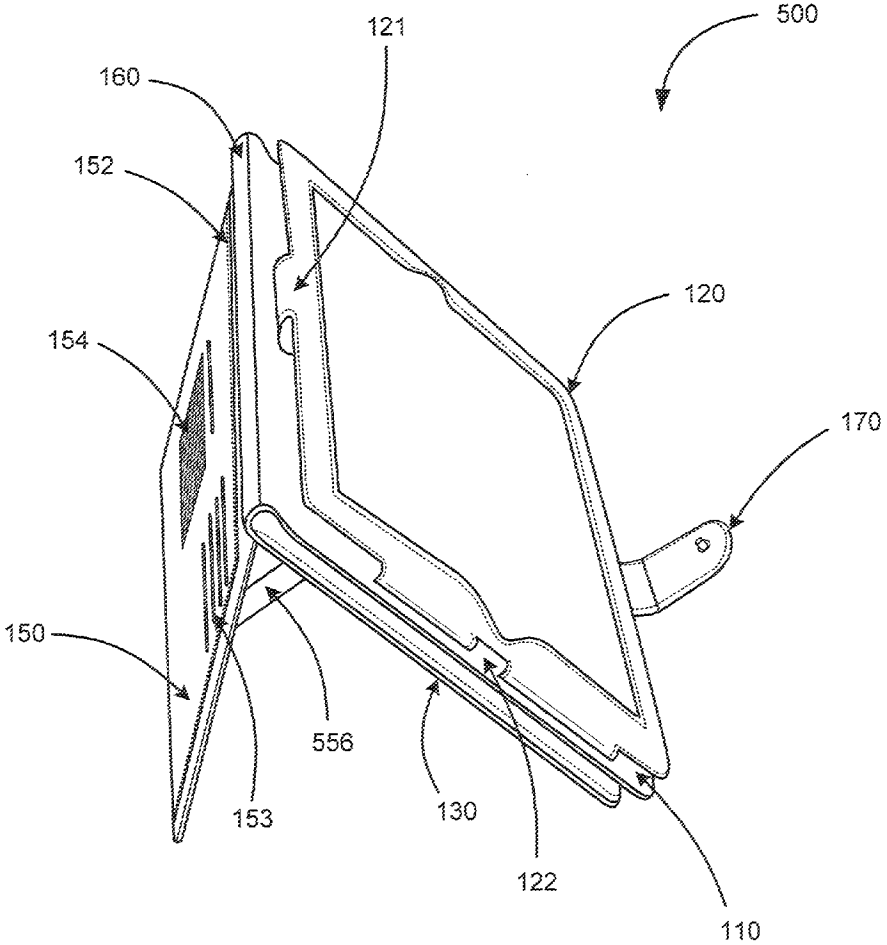
FIG. 5B depicts a perspective view of one embodiment of a case arranged in a second open configuration and in a second supported position.
Figure 5C:
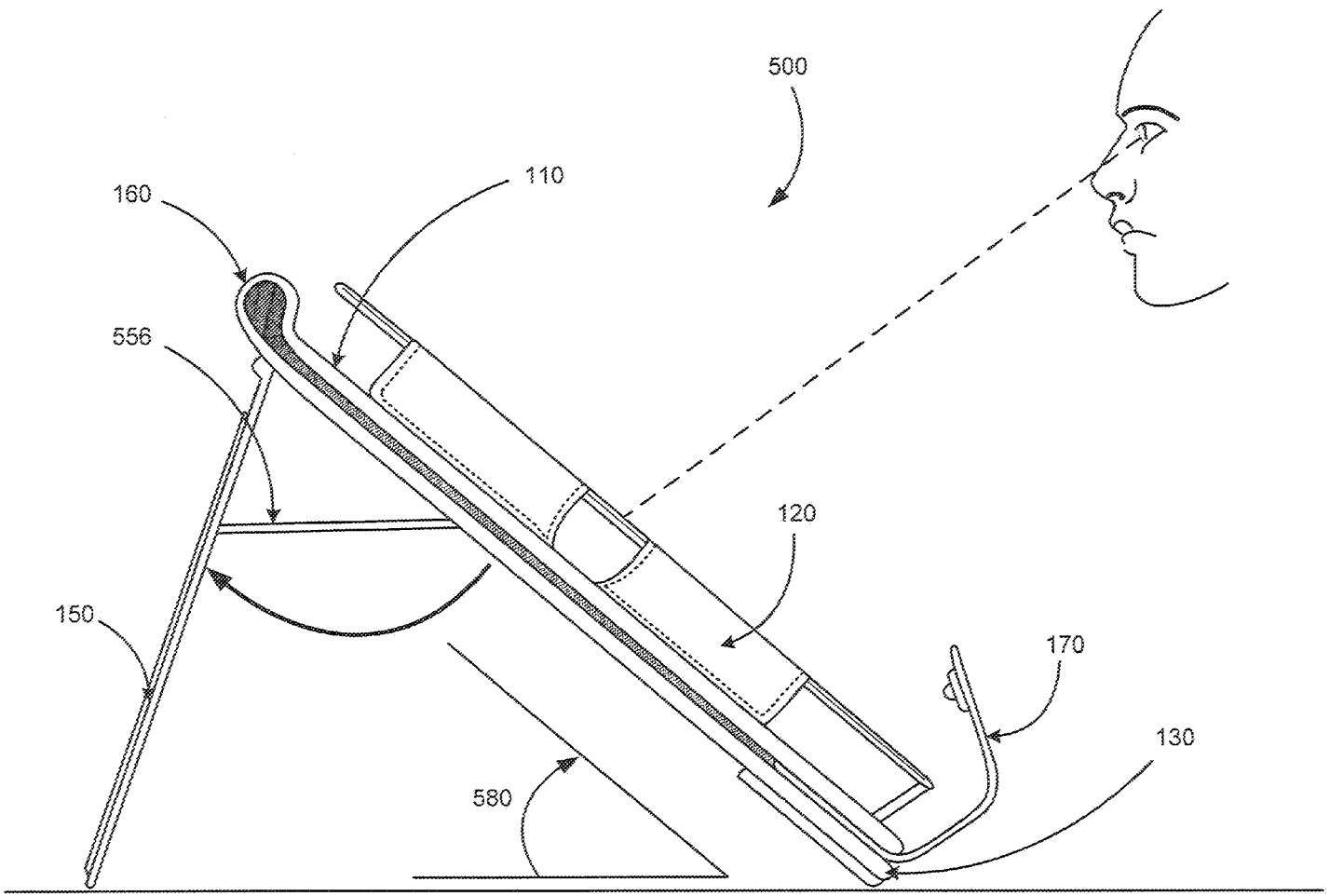
FIG. 5C depicts a side view of one embodiment of a case arranged in a second open configuration and in a second supported position.

The second support flap 150 is a rectangular and planar flap that may be used to raise one end of the bifold case 100 into a second supported position, as seen in FIGS. 5B and 5C. The second supported position places a screen of the personal electronic device 101 at a second angle relative to the surface upon which the bifold case 100 rests. The second support flap 150 attaches to a second portion of the second panel 130 via a second flap connector 151. The second flap connector 151 may comprise a flexible joint, a mechanical hinge, or any other suitable connector. For example, the second flap connector 151 may be made from a fabric, leather, a hinge, or another material or mechanism such that the second support flap 150 and the second panel 130 can pivot in relation to each other.

The second support flap 150 can be arranged in a folded position and an extended position. When in the folded position, the second support flap 150 lies flat against the second panel 130. To transition to the extended position, the second support flap 150 is rotated away from the second panel 130 to a maximum rotation angle. In some embodiments, the second support flap 150 may comprise one or more first rotation limiters configured to restrict the amount by which the second support flap 150 can rotate. Embodiments of the first rotation limiter(s) will be discussed in detail below with reference to FIGS. 5A-5C.

In some embodiments, the second support flap 150 comprises one or more receptacles configured to receive flat items. These receptacles may comprise a pocket 152, one or more card slots 153, or an ID slot 154. The pocket 152 may be configured to hold objects such as, but not limited to, currency, papers, documents, coupons, or other suitable sized or shaped objects. In some embodiments, the pocket 152 holds small number of objects and is limited in thickness to minimize contact between the second support flap 150 and a screen of the portable electronic device 101 when the bifold case 100 is arranged in a closed configuration. In other embodiments, the pocket 152 is configured to hold thicker objects. In some embodiments, the pocket 152 is configured to hold accessories for the portable electronic device 101, including headphones, styluses, memory cards (e.g., SD cards), port adapters, cables, or the like. The ID slot 154 comprises a windowed card holder and is configured to hold an identification card such as a driver's license, a student identification card, identification badge, or other suitable photo identification card. The card slots 153 may comprise slots or pockets located in the second support panel and configured to hold credit cards or similarly shaped objects. In some embodiments a second ID slot is provided in lieu of the one or more card slots 153. In some embodiments, a second set of one or more card slots is provided in lieu of the ID slot 154. One of skill in the art will recognize considerable variation within the scope of the present disclosure regarding how a various pockets, card slots, and ID slots may be arranged on the second support flap 150.

In some embodiments, the second support flap 150 may be rigid or semi-rigid to maintain its shape. In one embodiment, a rigid or semi-rigid second support flap 150 retains its planar shape and supports the bifold case 100 and/or second panel 130 when the bifold case 100 is configured in an elevated or supported position. For example, if the second support flap 150 is extremely flexible it may not hold its shape enough to support the bifold case 100 and/or portable electronic device 101 in the elevated or supported positions depicted in FIG. 4C or 5B.

The second support flap 150 may be formed of a variety of materials including a fabric, leather, plastic, composite, metal, or any other material. In some embodiments, an outer portion of the second support flap 150 may be formed of a soft or protective material to reduce scratching of a portable electronic device 101. For example, a surface of the second support flap 150 that faces the device receptacle 120 when the bifold case 100 is in a closed configuration may be formed of a soft fabric, lint free cloth, suede leather or imitation suede leather, or the like. Other portions of the second support flap 150 may include the same or other materials to provide a pleasing appearance to the bifold case 100. In some embodiments, the second support flap 150 may be formed of rigid or semi-rigid material such that the second support flap 150 maintains its planar shape. For example, a portion of the second support flap 150 may be formed of a variety of rigid or semi-rigid materials including a fabric, leather, plastic, composite, metal, or any other suitable material. Other portions of the second support flap 150 may include the same or other materials to provide a pleasing appearance to the bifold case 100.

As seen in FIG. 1A, the second support flap 150 may be significantly longer than the first support flap 140. The different lengths of the support flaps 140 and 150 define different viewing angles according to trigonometric principles. The different viewing angles may allow for a user to select a preferred angle for a current task, such as reading, watching video, typing using a virtual keyboard, typing using a separate physical keyboard, or other task.

While FIG. 1A shows the first support flap 140 and the second support panel 150 attached to a left portion and/or edge and a right portion and/or edge, respectively, of the second panel, in other embodiments, the support flaps 140, 150 attach to different portions and/or edges of the second panel 130. For example, the first support flap 140 may attach to the right edge of the second panel 130 and the second support flap 150 may attach to the left edge of the second panel 130. As another example, the first support flap 140 may attach to the upper edge of the second panel 130 and the second support flap 150 may attach to the lower edge of the second panel 130 (or vice versa).

The panel connector 160 is attached to both the first panel 110 and the second panel 130 and functions to join the two panels together. The panel connector 160 may comprise a flexible joint, a mechanical hinge, or other suitable connector. The panel connector 160 may be formed of a variety of materials including a fabric, leather, plastic, composite, metal, or any other material. In some embodiments, the panel connector 160 comprises shock absorptive material to protect against shock damage if the bifold case 100 holding personal electronic device 101 is dropped. For example, a layer of padding may be formed within the panel connector 160 to absorb the impact of a fall or drop. The padding may be formed of polymer, leather, fabric, felt, gel, foam, rubber, synthetic rubber, or other suitable shock absorptive material. In some embodiments, an inner portion of the panel connector 160 may be formed of a soft or protective material to reduce scratching of the device receptacle 120 and/or a portable electronic device 101. For example, a surface of the panel connector 160 that faces the device receptacle 120 may be formed of a soft fabric, lint free cloth, suede leather or imitation suede leather, or the like. Other portions of the panel connector 160 may include the same or other materials to provide a pleasing appearance to the bifold case 100. In some embodiments, an outer portion of the panel connector 160 may be formed of a scratch-resistant material to reduce scratching of the bifold case 100. Other portions of the panel connector 160 may include the same or other materials to provide a pleasing appearance to the bifold case 100.

In some embodiments, the bifold case 100 comprises a closure 170 configured to selectively maintain the bifold case 100 in a closed configuration. The closure 170 may consist of a strap or buckle extending from (or permanently affixed to) a distal end of the first panel 110 and selectively attached to the second panel 130. As will be understood by one of skill in the art, the closure 170 may extend from the second panel 130 and attach to the first panel 110. The closure 170 may comprise any suitable latching mechanism, including, but not limited to, snap fasteners, hook-and-loop fasteners, hook-and-eye fasteners, magnets, buttons, buckles, zippers, ties, adhesives, latches, retaining pins or clips, or the like.

The closure 170 may be formed of a variety of materials including a fabric, leather, plastic, composite, metal, or any other material. In some embodiments, an inner surface portion of the closure 170 may be formed of a soft or protective material to reduce scratching of the device receptacle 120 and/or a portable electronic device 101. For example, a surface of the closure 170 adjacent to the device receptacle 120 may be formed of a soft fabric, lint free cloth, felt, suede leather or imitation suede leather, or the like. Other portions of the closure 170 may include the same or other materials to provide a pleasing appearance to the bifold case 100. In some embodiments, the closure 170 may be formed of semi-rigid or flexible material such that the closure 170 may be folded to attach to the second panel 130 (or first panel 110) or folded away from the device receptacle 120. For example, the closure 170 may be formed of a variety of semi-rigid or flexible materials including a fabric, leather, plastic, composite, metal mesh, or any other suitable material. In some embodiments, an outer portion of the closure 170 may be formed of a scratch-resistant material to reduce scratching of the bifold case 100. Other portions of the closure 170 may include the same or other materials to provide a pleasing appearance to the bifold case 100.

Figure 2A:
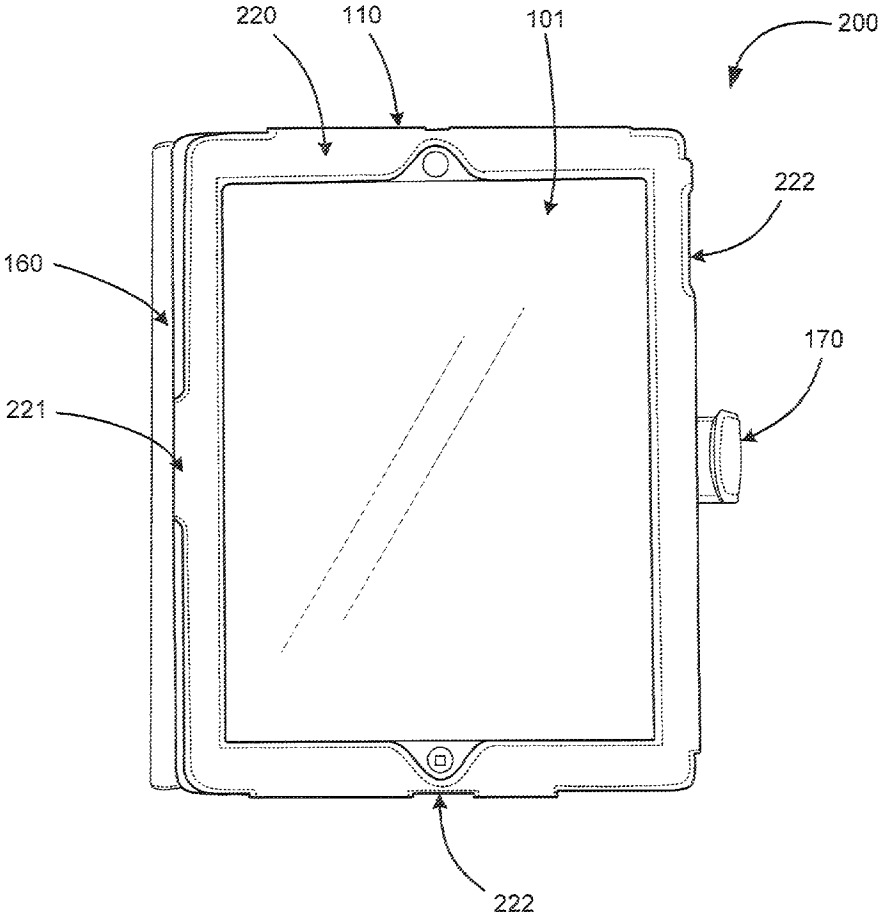
FIG. 2A depicts one embodiment of a case arranged in a second open configuration.
Figure 2B:
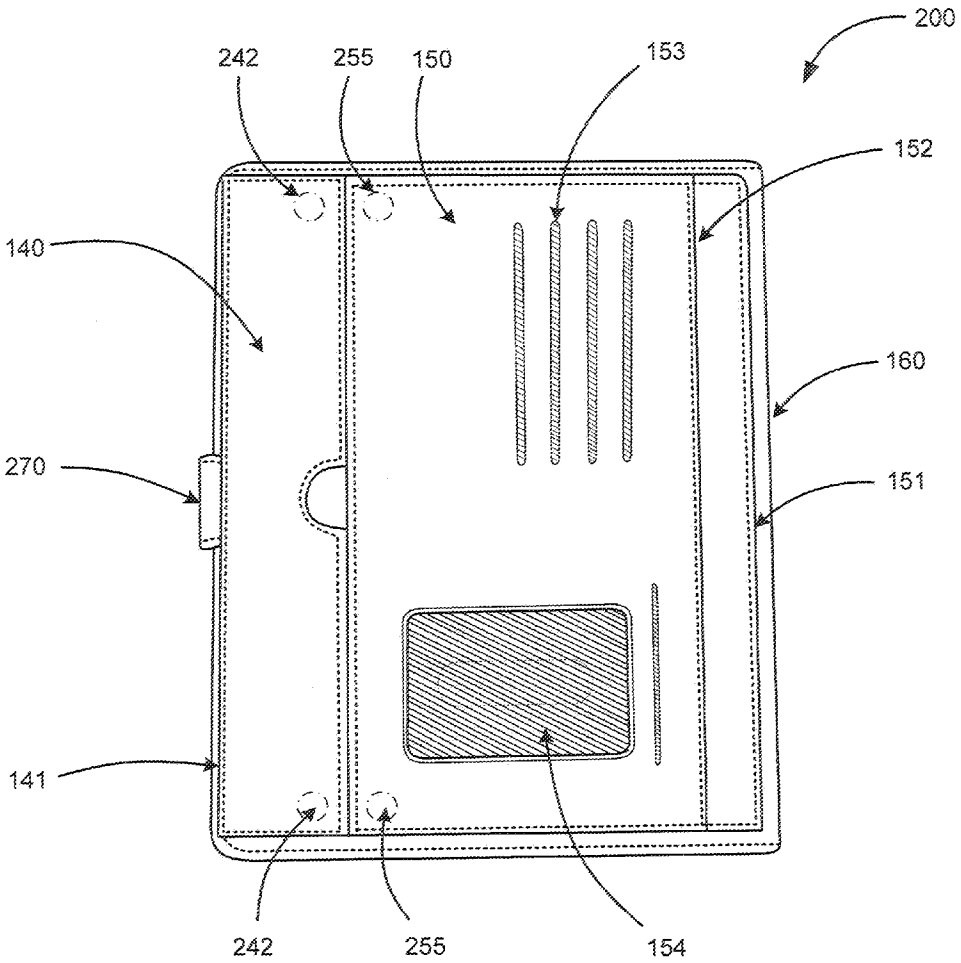
FIG. 2B depicts another embodiment of a case arranged in a second open configuration.
Figure 2C:
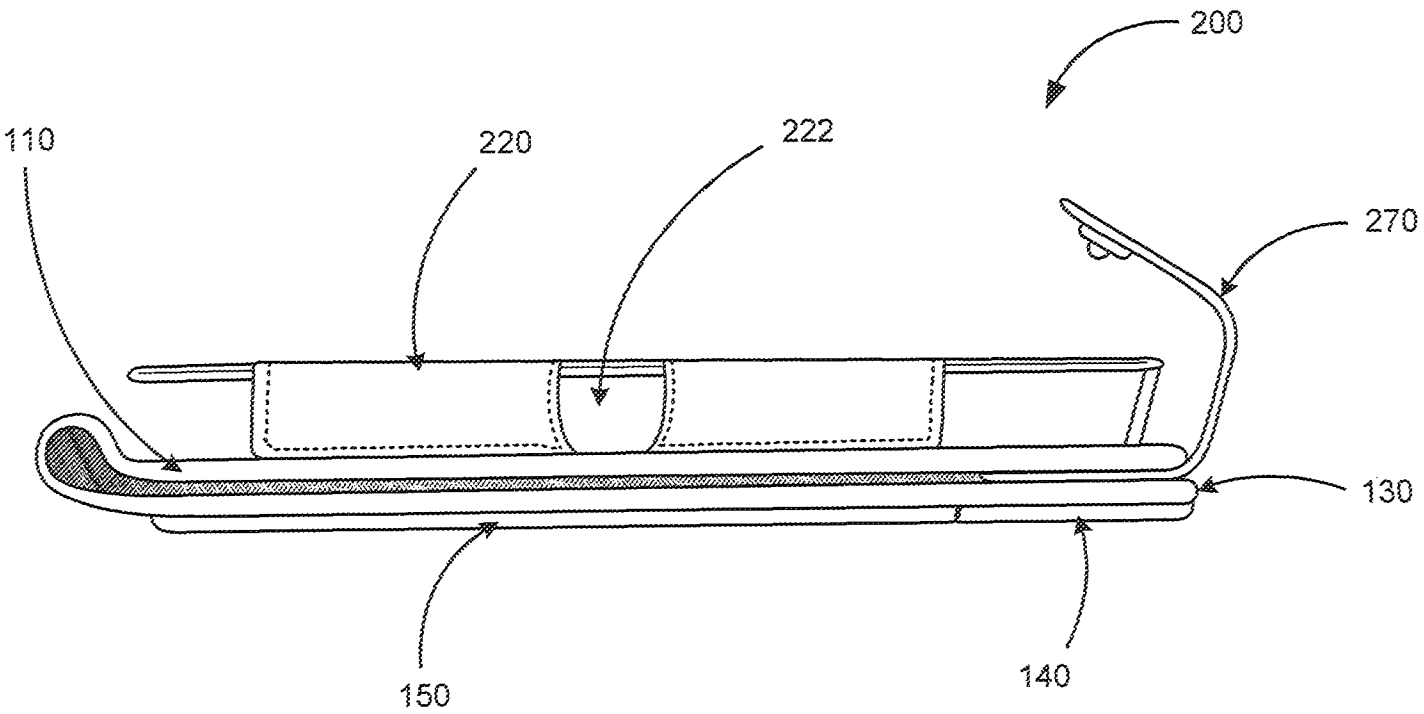
FIG. 2C depicts a side view of one embodiment of a case arranged in a second open configuration.

FIGS. 2A-2C are views illustrating embodiments of a case 200 for a portable electronic device 101. The case 200 may be similar to the bifold case 100. The case 200 may comprise a first panel 110, a device enclosure 220, a second panel 130, a first support stand 140, a second support stand 150, a panel joint 260, and a panel latch 270. Here the case 200 is arranged in a second opened position where the first panel 110 and the second panel 130 are adjacent to each other and approximately parallel to each other.

The device enclosure 220 may be configured to enclose and selectively release a portable electronic device 101. The device enclosure comprises an enclosure fastener 221 that selectively fastens to the first panel 110 thereby securing the portable electronic device 101 within the device enclosure 120. The device fastener 121 may comprise any suitable fastener, including, but not limited to, a snap fastener, a hook-and-loop fastener, a hook-and-eye fastener, one or more magnets, a button, a buckle, a zipper, a tie, an adhesive, a retaining pin or clip, or the like.

In some embodiments, the device enclosure 220 comprises one or more control windows 222 configured to allow a user access to buttons, switches, ports, and/or slots located on a portable electronic device 101. The control window(s) 222 are located at suitable positions on the device enclosure 220 to allow for user manipulation of the controls, ports, and/or slots of the portable electronic device 101. As will be understood by one of skill in the art, the control window(s) 222 may be modified to accommodate the various locations and dimensions of controls, ports, and/or slots, of a specific portable electronic device 101. Further, the number of control windows 222 provided in the device enclosure 220 may vary according to the number and location of controls, ports, and/or slots of a specific portable electronic device 101.

The panel latch 270 may be configured to selectively maintain the case 200 in a closed configuration and may be a specific example of the closure 170. As seen in FIG. 2C, the panel latch 270 may be interposed between the first panel 110 and the second panel 130 so that there is a gap between the two panels. In other embodiments, the closure 170 sits flush with the first panel 110 so that there is no gap between first panel 110 and second panel 130. The second opened position is more compact than the first opened position and the case may be more easily held in the hand by a user.

Referring to FIG. 2B, in some embodiments the case 200 may comprise one or more first support flap retainers 242 to selectively retain the first support flap 140 in a folded position while the case 200 is in the second opened position. The first support flap retainer 242 applies bias to the first support flap 140 so that it remains in a folded position but can be selectively freed to rotate to the extended position. The case 200 may also comprise one or more second support flap retainers 255 to selectively retain the second support flap 150 in a folded position while the case 200 is in the second opened position. The second support flap retainer 255 applies bias to the second support flap 150 so that it remains in a folded position but can be selectively freed to rotate to the extended position. The support flap retainers 242, 255 ensure that the second opened position is a compact arrangement of the case 200 and that the support flaps 140, 150 do not catch on surrounding objects.

In some embodiments, the first support flap retainer 242 comprises at least one pair of magnetic devices. The magnetic devices may comprise a pair of magnets, a magnet and a corresponding ferromagnetic material (e.g., steel, iron, or nickel), or other suitable devices attracted to each other via magnetic forces. One magnetic device of the pair may be located in the first support flap 140 while the other magnetic device of the pair may be located in the second panel 130. The magnetic attraction between the first support flap retainers 242 maintains the first support flap 140 in the folded position. In some embodiments, the magnetic first support flap retainer 242 is configured to interact with sensors of a portable electronic device 101 such that the change in magnetic field caused by opening the case 200 triggers the portable electronic device 101 to wake up or power up and the change in magnetic field caused by closing the case 200 triggers the portable electronic device 101 to sleep or power down.

In some embodiments, the first support flap retainer 242 comprises at least one bistable spring having a first stable position corresponding to the folded position of the first support flap 140 and a second stable position corresponding to the extended position of the first support flap 140. The bistable spring attaches to the first support flap 140 and to the second panel 130. In some embodiments, the bistable spring passes through the first flap connector 141. In other embodiments, the bistable spring is located adjacent to the first flap connector 141.

In some embodiments the second support flap retainer 255 comprises at least one pair of magnetic devices. The magnetic devices may comprise a pair of magnets, a magnet and a corresponding ferromagnetic material (e.g., steel, iron, or nickel), or other suitable devices attracted to each other via magnetic forces. One magnetic device of the pair may be located in the second support flap 150 while the other magnetic device of the pair may be located in the second panel 130. The magnetic attraction between the magnetic devices maintains the second support flap 150 in the folded position. In some embodiments, the magnetic second support flap retainer 255 is located and/or configured to interact with magnetic sensors embedded in the portable electronic device 101 such that the change in magnetic field caused by opening the bifold case 100 (i.e., arranging the bifold case 100 in an opened configuration) triggers the portable electronic device 101 to wake up or power up and the change in magnetic field caused by closing the bifold case 100 (i.e., arranging the bifold case 100 in a closed configuration) triggers the portable electronic device 101 to sleep or power down.

In some embodiments, the second support flap retainer 255 comprises at least one bistable spring having a first stable position corresponding to the folded position of the second support flap 150 and a second stable position corresponding to the extended position of the second support flap 150. The bistable spring attaches to the second support flap 150 and to the second panel 130. In some embodiments, the bistable spring passes through the second flap connector 151. In other embodiments, the bistable spring is located adjacent to the second flap connector 151.

As seen in FIG. 2B, the pocket 152 is most easily accessible when the case 200 is arranged in the second opened position. In the second opened position, the device enclosure 220 will not interfere with objects being placed into or removed from the pocket 152. Similarly, the card slots 153 and the ID slot 154 may be easily accessible when the case 200 is arranged in the second opened position.

Figure 3A:
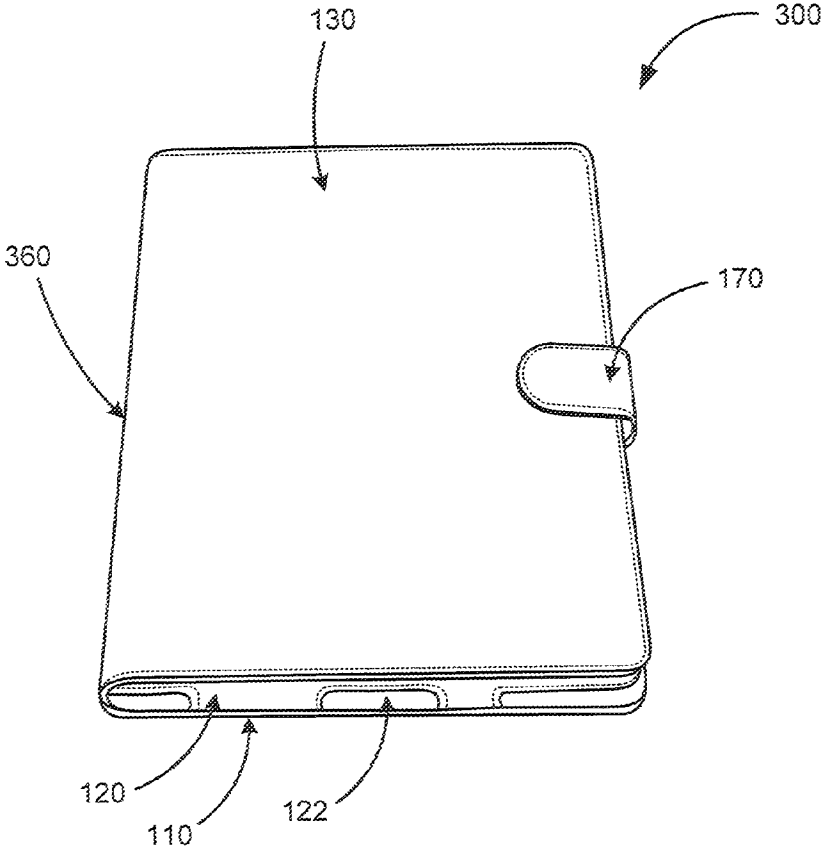
FIG. 3A depicts a perspective view of one embodiment of a case arranged in a closed configuration.
Figure 3B:
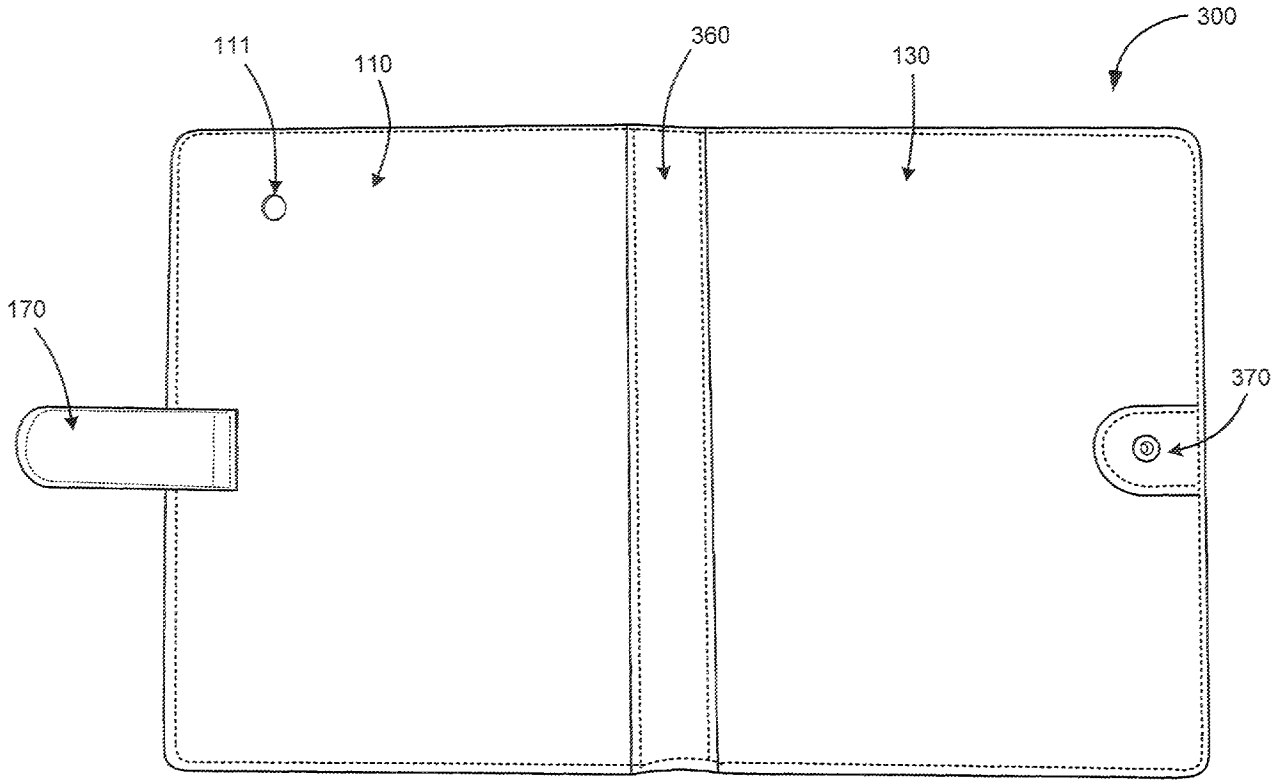
FIG. 3B depicts another embodiment of a case arranged in a first open configuration.

FIGS. 3A and 3B are views illustrating embodiments of an exterior portion of a case 300 for a portable electronic device. FIG. 3A illustrates a perspective view of one embodiment of the case 300 arranged in a closed configuration. The closed position of FIG. 3A may be conducive to the carrying or transportation of a portable electronic device (not shown). The portable electronic device may be enclosed within the case 300 and be protected from damage. The case 300 may be similar to the cases 100 and/or 200. The first panel 110 and device receptacle 120 retain a portable electronic device such that the backside and edges of the portable electronic device are substantially protected. In some embodiments, first panel 110 comprises a camera window 111 through which a camera of a portable electronic device may capture images of scenes and/or objects exterior to the case 300. The second panel 130 covers a screen of a portable electronic device when the case 300 is in the closed configuration. The case 300 in a closed configuration may form a compact and/or stylish carrying case for the portable electronic device. The case 300 may be secured in the closed configuration by closure 170 which may be selectively attached to second panel 130. As seen in FIG. 3A, while the case 300 is arranged in a closed configuration, a user may access controls or ports or a portable electronic device via access slot 122. For example, a user may use access slot 122 to charge a portable electronic device while the case 300 is arranged in the closed configuration.

FIG. 3B illustrates a view of one embodiment of an exterior of the case 300 arranged in a first open configuration. The case 300 may comprise a first panel 110 that is permanently attached to second panel 130 by panel joint 360. Panel joint 360 comprises a flexible joint configured to join the first panel 110 to the second panel 130 and is a specific example of panel connector 160. In some embodiments, the panel joint 360 comprises flexible material permanently attached to the first panel 110 on one side and to the second panel 130 on the opposite side. In these embodiments, the panel joint 130 may be formed of a variety of flexible materials including a fabric, leather, plastic, composite, or any other suitable material.

In some embodiments, the first panel 110, second panel 130, and panel joint 360 are one unitary panel with a portion of the unitary panel corresponding to the first panel 110, a portion corresponding to the second panel 130, and a portion corresponding to the panel joint 360. In these embodiments, the unitary panel may be formed of a variety of semi rigid materials such that the first panel 110 and second panel 130 portions provide the needed support and maintain their shape while the panel joint 360 can flex and bend into the closed and open configurations.

In some embodiments, the panel joint 360 may be formed at one side of the first panel 110 and attached to the second panel 130. In other embodiments, the panel joint 360 may be formed at one side of the second panel 130 and attached to the first panel 110. In some embodiments, the first panel 110, the second panel 130, and the panel joint 360 comprise at least two pieces of material that share a unitary outer layer or inner layer. One of skill in the art will recognize considerable variation within the scope of the present disclosure regarding how a first panel 110 may be connected to a second panel 130.

The exterior of the case 300 may be formed of a variety of materials. For example, the exterior may include various materials, such as fabric, plastic, rubber, metal, leather, faux leather, vinyl, nylon, and/or any of a wide variety of alternative decorative or useful materials utilized in cases, bags, luggage, and the like. In some embodiments, the exterior of the case 300 may be formed of a scratch-resistant material so as to reduce scratching of the case 300. Other portions of the case 300 may include the same or other materials to provide a pleasing appearance to the case 300.

As seen in FIG. 3B, the case 300 may comprise a closure 170 attached to the first panel 110 and configured to selectively maintain the case 300 in a closed configuration by selectively attaching to a corresponding receiver 370 on the second panel 130. As will be understood by one of skill in the art, the closure 170 may extend from the second panel 130 and attach to a receiver 370 on the first panel 110. The closure 170 and corresponding receiver 370 may comprise any suitable fasteners, including, but not limited to, snap fasteners, hook-and-loop fasteners, hook-and-eye fasteners, magnets, buttons, buckles, zippers, ties, adhesives, latches, retaining pins or clips, or the like. As seen in FIG. 3B, the closure 170 may comprise a strap having a male snap fastener and that extends from the first panel 110 to selectively attach to the corresponding receiver 370 comprising a female snap fastener that is located on the second panel 130. While FIG. 3B shows one strap, in other embodiments the case 300 may comprise a plurality of closures 170 that attach to a plurality of receivers 370.

FIGS. 4A-4D are views of a case 400 for a portable electronic device 101. The case 400 may be similar to the cases 100, 200, and/or 300. The case 400 comprises a first panel 110, a device receptacle 120, a second panel 130, a first support flap 140, a second support flap 150, a panel connector 160, and a closure 170. FIGS. 4A-4D illustrate the case 400 having the first support flap 140 arranged in an extended position. FIGS. 4A and 4B illustrate the case 400 arranged in a first opened configuration while FIGS. 4C and 4D illustrate the case 400 arranged in a second open configuration.

FIG. 4A illustrates a top view of the case 400 which may comprise a first rotation limiter 443 configured to limit the rotation of first support flap 140. The first support flap 140 is attached to the second panel 130 via the first flap connector 141. The first support flap 140 may rotate with respect to the second panel 130 up to a maximum rotation angle defined by the first rotation limiter 443. In some embodiments, the first rotation limiter 443 is adjustable, such that the maximum rotation angle may be adjusted. While FIG. 4A shows the first support flap 140 attached to a left portion and/or edge of the second panel, in other embodiments, the support flap 140 attaches to different portions and/or edges of the second panel 130. For example, the first support flap 140 may attach to the right edge of the second panel 130. As another example, the first support flap 140 may attach to the upper edge (or the lower edge) of the second panel 130.

As seen in FIG. 4B, the first support flap 140 comprises a proximal end 440A and a distal end 440B. In one embodiment, the first support flap 140 is pivotably coupled to the second panel 130 at the first support flap's proximal end 440A. The first flap connector 441 may secure the first support panel 140 to the second panel 130 at the first support flap's proximal end 440A. As discussed above, the first flap connector 441 may comprise a flexible joint, a mechanical hinge, or any other suitable connector such that the first support flap 140 and the second panel 130 can pivot in relation to each other. The distal end of the first support flap 440B may be free or selectively freed from the second panel 130 to allow the second support flap to be extended. In some embodiments, the first support flap 140 is selectively affixed to the second panel 130 via one or more first support flap retainers 242.

In some embodiments, the first rotation limiter 443 comprises a strap or ribbon affixed to the first support flap 140 at one end and to the second panel 130 at the other end. When the first support flap 140 is in a folded position (i.e., flush against the second panel 130) the strap or ribbon is slack. As the first support flap 140 pivots away from the second panel 130, the slack is taken out of the strap or ribbon until the strap or ribbon is pulled taut. The taut strap or ribbon prevents further rotation of the first support flap 140. The maximum rotation angle of the first support flap 140 (i.e., the maximum angle to which the first support flap can rotate) is determined by both the length of the first rotation limiter 443 and the distance between the first flap connector 141 and the attachment point of the first rotation limiter 443.

In some embodiments, the first rotation limiter 443 comprises a pair of flat, rigid members that are joined together at one end via a flexible joint or hinge. One flat member is attached to the first support flap 140 while the other is attached to the second panel 130. When the first support flap 140 is in a folded position (i.e., flush against the second panel 130) the flat members lie atop each other and the angle formed between the two flat members is substantially 0°. As the first support flap 140 rotates away from the second panel 130, the flat members pivot around their joint, or hinge, and the angle between the flat members increases to a maximum angle of 180°. At this maximum angle, the joined flat members are fully extended. The fully extended flat members prevent further rotation of the first support flap 140. The maximum rotation angle of the first support flap 140 (i.e., the maximum angle to which the first support flap can rotate) is determined by both the length of the first rotation limiter 443 and the distance between the first flap connector 141 and the attachment point of the first rotation limiter 443. In some embodiments, the first rotation limiter 443 is omitted because a bistable spring is used to bias the first support flap 140 in a folded position or an open position. In other embodiments, the first rotation limiter 443 acts conjunction with a bistable spring to limit the rotation of the first support flap.

As seen in FIGS. 4C and 4D, when the case 400 is arranged in the second opened configuration and the first support flap 140 is in an extended position, the case 400 may be propped up upon a supporting surface such that the ends of the first panel 110 and the second panel 130 that are opposite the panel connector 160 are elevated above the supporting surface. This arrangement of the case 400 is referred to as the first supported position. The first supported position places a screen of the personal electronic device 101 at a first angle 480 relative to the surface upon which the case rests. This first angle 480 corresponds to a first viewing angle as the supported position allows a user to view the screen at the first viewing angle. As seen in FIG. 4D, in some embodiments, the closure 170 may be interposed between the first panel 110 and the second panel 130 so that there is a gap or space between the two panels. In other embodiments, the closure 170 sits flush with the first panel 110 so that there is no gap between first panel 110 and second panel 130.

FIGS. 5A-5C are views of a case 500 for a portable electronic device 101. The case 500 may be similar to the cases 100, 200, 300, and/or 400. The case 500 comprises a first panel 110, a device receptacle 120, a second panel 130, a first support flap 140, a second support flap 150, a panel connector 160, and a closure 170. FIGS. 5A-5C illustrate the case 500 having the second support flap 150 arranged in an extended position. FIG. 5A is a perspective view of the case 500 arranged in a first opened configuration. FIGS. 5B-5C are a perspective and a side view, respectively, of the case 500 in a second opened configuration.

FIG. 5A is a top view of case 500 which may comprise a second rotation limiter 556 configured to limit the rotation of second support flap 150. The second support flap 150 is attached to the second panel 130 via the second flap connector 151. The second support flap 150 may rotate with respect to the second panel 130 up to a maximum rotation angle defined by the second rotation limiter 556. In some embodiments, the second rotation limiter 556 is adjustable, such that the maximum rotation angle may be adjusted. While FIG. 5A shows the second support panel 150 attached to a right portion and/or edge of the second panel 130, in some embodiments the support flap 150 attaches to different portions and/or edges of the second panel 130. For example, the second support flap 150 may attach to the left edge of the second panel 130. As another example, the second support flap 150 may attach to the lower edge (or to the upper edge) of the second panel 130.

As seen in FIG. 5A, the second support flap 150 comprises a proximal end 550A and a distal end 550B. In one embodiment, the second support flap 150 is pivotably coupled to the second panel 130 at the at the second support flap's proximal end 550A. The second flap connector 151 may secure the second support flap 150 to the second panel 130 at the second support flap's proximal end 550A. As discussed above, the second flap connector may comprise a flexible joint, a mechanical hinge, or any other suitable connector. For example, the second flap connector may be made from a fabric, leather, a hinge, or another material or mechanism such that the second support flap 150 and the second panel 130 can pivot in relation to each other. The distal end of the second support flap 550B may be free or selectively freed from the second panel 130 to allow the second support flap to be extended. Second support flap 150 may be selectively affixed to the second panel 130 via one or more second support flap retainers 255.

In some embodiments, the second rotation limiter 556 comprises a strap or ribbon affixed to the second support flap 150 at one end and to the second panel 130 at the other end. When the second support flap 150 is in a folded position (i.e., flush against the second panel 130) the strap or ribbon is slack. As the second support flap 150 pivots away from the second panel 130, the slack is taken out of the strap or ribbon until the strap or ribbon is pulled taut. The taut strap or ribbon prevents further rotation of the second support flap 150. The maximum rotation angle of the second support flap 150 (i.e., the maximum angle to which the second support flap 150 can rotate) is determined by both the length of the second rotation limiter 556 and the distance between the second flap connector 151 and the attachment point of the second rotation limiter 556. In some embodiments, the second rotation limiter 556 comprises a strap whose length can be adjusted. By adjusting the length of the strap, a user can vary the maximum rotation angle that the second support flap 150 can rotate. The second viewing angle is related to the length of the second support flap 150 and its maximum rotation angle according to the principles of trigonometry. Thus, when the maximum rotation angle of the second support flap is changed, the second viewing angle is also changed.

In some embodiments, the second rotation limiter 556 comprises a pair of flat, rigid members that are joined together at one end via a flexible joint or hinge. One flat member is attached to the second support flap 150 while the other is attached to the second panel 130. When the second support flap 150 is in a folded position (i.e., flush against the second panel 130) the flat members lie atop each other and the angle formed between the two flat members is substantially 0°. As the second support flap 150 rotates away from the second panel 130, the flat members pivot around their joint, or hinge, and the angle between the flat members increases to a maximum angle of 180°. At this maximum angle, the joined flat members are fully extended, thereby preventing further rotation of the second support flap 150. The maximum rotation angle of the second support flap 150 (i.e., the maximum angle to which the second support flap can rotate) is determined by both length of the second rotation limiter 556 and the distance between the second flap connector 151 and the attachment point of the second rotation limiter 556. In some embodiments, the second rotation limiter 556 is omitted because a bistable spring is used to bias the second support flap 150 in a folded position or an open position. In other embodiments, the second rotation limiter 556 acts conjunction with a bistable spring to limit the rotation of the second support flap 150.

As seen in FIGS. 5B and 5C, when the case 500 is arranged in the second opened configuration and the second support flap 150 is in an extended position, the case 500 may be propped up upon a supporting surface such that the ends of the first panel 110 and the second panel 130 that are attached to the panel connector 160 are elevated above the supporting surface. This arrangement of the case 500 is referred to as the second supported position. The second supported position places a screen of the personal electronic device 101 at a second angle 580 relative to the surface upon which the case rests. This second angle 580 corresponds to a second viewing angle as the supported position allows a user to view the screen at the second viewing angle. The different angles of FIG. 4B and FIG. 5C may allow for a user to select a preferred angle for a current task, such as reading, watching video, typing using a virtual keyboard, typing using a separate physical keyboard, or other task. As seen in FIG. 5C, in some embodiments, the closure 170 may be interposed between the first panel 110 and the second panel 130 so that there is a gap or space between the two panels. In other embodiments, the closure 170 sits flush with the first panel 110 so that there is no gap between first panel 110 and second panel 130.

Figure 6A:
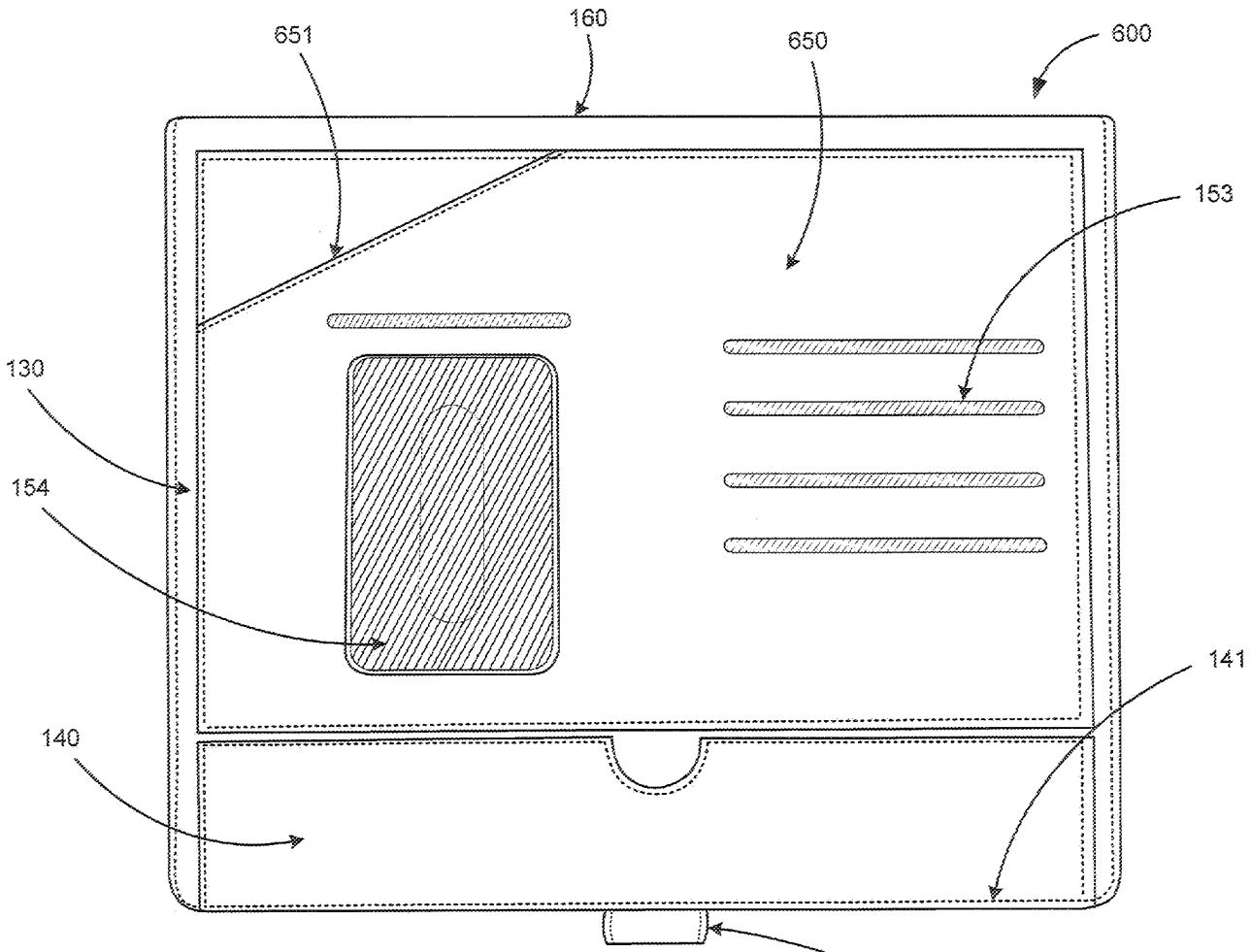
FIG. 6A depicts another embodiment of a case arranged in a first open configuration.
Figure 6B:
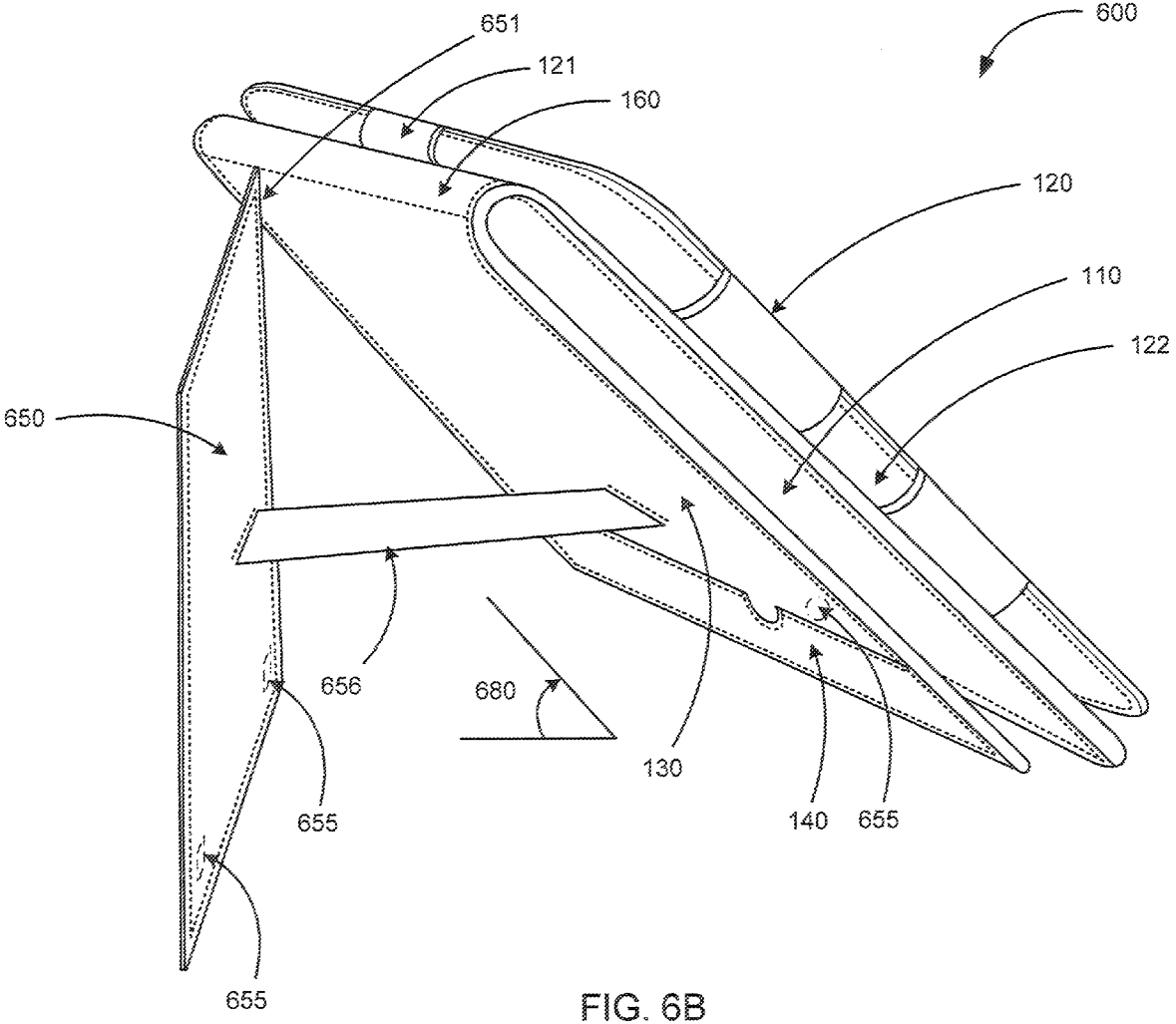
FIG. 6B depicts a perspective view of one embodiment of a case arranged in a second open configuration and in a third supported position.
Figure 6C:
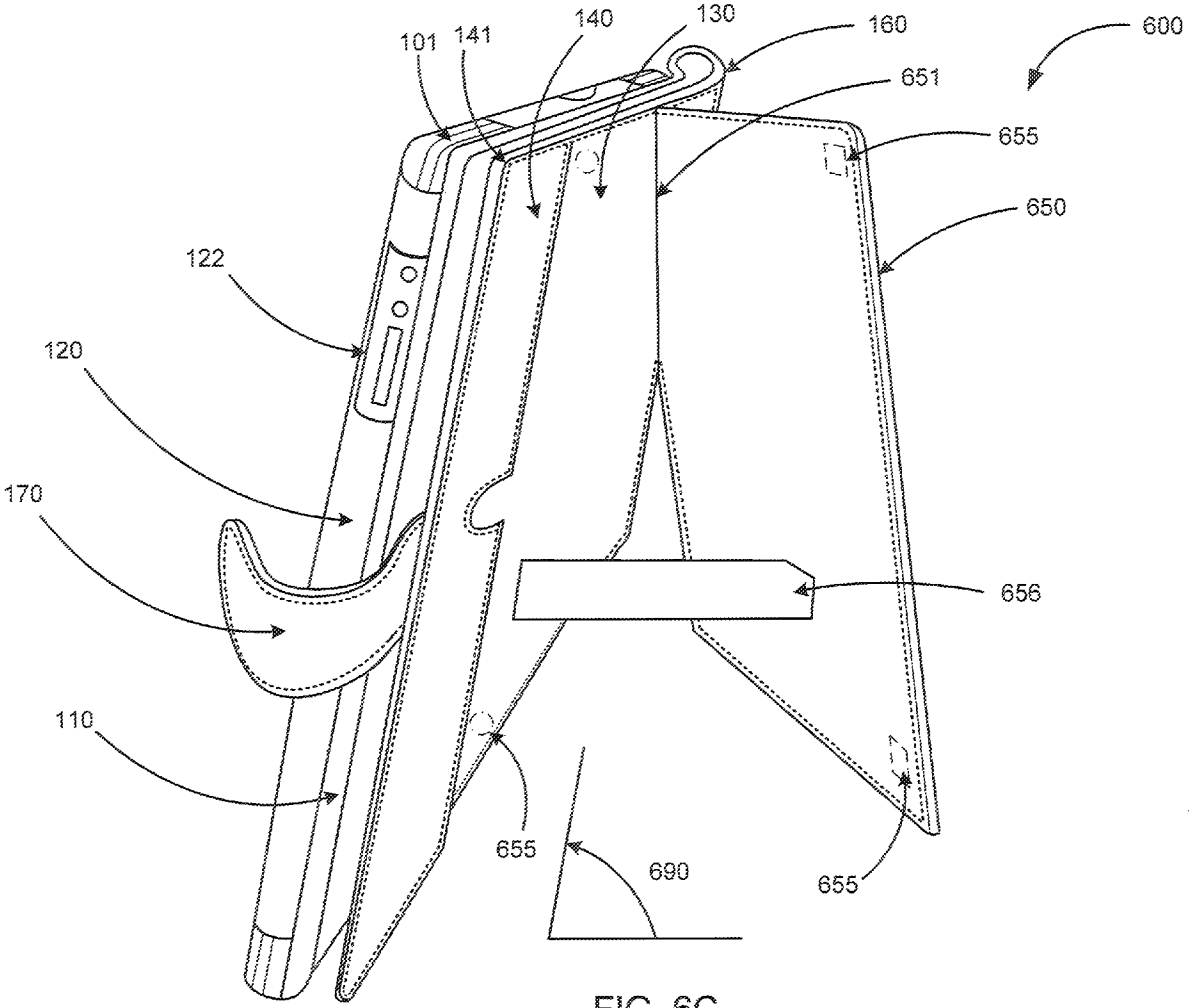
FIG. 6C depicts a perspective view of another embodiment of a case arranged in a second open configuration and in a third supported position.

FIGS. 6A-6C are views of a case 600 for a portable electronic device 101. The case 600 comprises a first panel 110, a device receptacle 120, a second panel 130, a first support flap 140, an angled support flap 650, a panel connector 160, and a closure 170. FIG. 6A is a top view of an embodiment of case 600 in a second opened configuration, while FIGS. 6B and 6C are perspective views of embodiments of case 600 in a second opened configuration.

As seen in FIGS. 6A-6C, the angled support flap 650 may replace the second support flap on the second panel 130. In one embodiment, the angled support flap 650 is pivotably coupled to the second panel 130 via the angled flap connector 551. The angled flap connector 551 may comprise a flexible joint, a mechanical hinge, or any other suitable connector. For example, the angled flap connector 551 may be made from a fabric, leather, a hinge, or another material or mechanism such that the angled support flap 650 and the second panel 130 can pivot in relation to each other. A distal end of the angled support flap 650 opposite the angled flap connector 551 may be free or selectively freed from the second panel 130 to allow the angled support flap 650 to be extended. The angled support flap 650 may be selectively affixed to the second panel 130 via one or more angled support flap retainers 655. While FIG. 6A shows the first support flap 140 attached to a bottom portion and/or edge, and the angled support panel 650 attached to an upper-left bottom portion and/or corner, of the second panel, in other embodiments, the support flaps 140, 650 attach to different portions of the second panel 130. For example, the first support flap 140 may attach to the upper, right, or left edges of the second panel 130. As another example, the angled support flap 650 may attach at the upper-right, lower-right, or lower-left corners of the second panel 130.

As seen in FIG. 6A, the first support flap 140 and the angled support flap 650 attach to the second panel 130 such that the first support flap 140 and the angled support flap 650 may each rotate with respect to the second panel 130. The axis of rotation of the first support flap 140 may be at an acute angle relative to the axis of rotation of the angled support flap 650. Thus, the angled flap connector 651 may be positioned at an angle relative to the first flap connector 141. The angled flap connector 651 allows the case to be elevated in both a landscape orientation (see FIG. 6B) and a portrait orientation (see FIG. 6C). The different orientations of FIG. 6B and FIG. 6C may allow for a user to select a preferred orientation for a current task, such as reading, watching video, typing using a virtual keyboard, typing using a separate physical keyboard, or other task.

The case 600 may comprise a third rotation limiter 656 configured to limit the rotation of angled support flap 650. The angled support flap 650 may rotate with respect to the second panel 130 up to a maximum rotation angle defined by the third rotation limiter 656. The embodiments of FIGS. 6B and 6C illustrate the case 600 having the angled support flap 650 arranged in an extended position. In some embodiments, the third rotation limiter 656 is adjustable, such that the maximum rotation angle may be adjusted.

In some embodiments, the third rotation limiter 656 comprises a strap or ribbon affixed to the angled support flap 650 at one end and to the second panel 130 at the other end. When the angled support flap 650 is in a folded position (i.e., flush against the second panel 130) the strap or ribbon is slack. As the angled support flap 650 pivots away from the second panel 130, the slack is taken out of the strap or ribbon until the strap or ribbon is pulled taut. The taut strap or ribbon prevents further rotation of the angled support flap 650. The maximum rotation angle of the angled support flap 650 (i.e., the maximum angle to which the angled support flap 650 can rotate) is determined by both the length of the third rotation limiter 656 and the distance between the angled flap connector 551 and the attachment point of the third rotation limiter 656. In some embodiments, the third rotation limiter 656 comprises a strap whose length can be adjusted. By adjusting the length of the strap, a user can vary the maximum rotation angle that the angled support flap 650 can rotate. The second viewing angle is related to the length of the angled support flap 650 and its maximum rotation angle according to the principles of trigonometry. Thus, when the maximum rotation angle of the second support flap is changed, the second viewing angle is also changed.

In some embodiments, the third rotation limiter 656 comprises a pair of flat, rigid members that are joined together at one end via a flexible joint or hinge. One flat member is attached to the angled support flap 650 while the other is attached to the second panel 130. When the angled support flap 650 is in a folded position (i.e., flush against the second panel 130) the flat members lie atop each other and the angle formed between the two flat members is substantially 0°. As the angled support flap 650 rotates away from the second panel 130, the flat members pivot around their joint, or hinge, and the angle between the flat members increases to a maximum angle of 180°. At this maximum angle, the joined flat members are fully extended, thereby preventing further rotation of the angled support flap 650. The maximum rotation angle of the angled support flap 650 (i.e., the maximum angle to which the second support flap can rotate) is determined by both length of the third rotation limiter 656 and the distance between the angled flap connector 551 and the attachment point of the third rotation limiter 656.

Referring to FIGS. 6B and 6C, in some embodiments the case 600 may comprise one or more angled support flap retainers 655 to retain the angled support flap 650 in a folded position while the case 600 is in a second opened position (e.g., where the first panel 110 and the second panel 130 are adjacent to each other and approximately parallel to each other). The angled support flap retainer 655 applies bias to the angled support flap 650 so that it remains in a folded position but can be selectively freed to rotate to the extended position. The angled support flap retainers 655 ensure that the second opened position is a compact arrangement of the case 600 and that the angled support flap 650 does not catch on surrounding objects.

In some embodiments, the angled support flap retainer 655 comprises at least one pair of magnetic devices. The magnetic devices may comprise a pair of magnets, a magnet and a corresponding ferromagnetic material (e.g., steel, iron, or nickel), or other suitable devices attracted to each other via magnetic forces. One magnetic device of the pair may be located in the angled support flap 650 while the other magnetic device of the pair may be located in the second panel 130. The magnetic attraction between the angled support flap retainers 655 maintains the angled support flap 650 in the folded position. In some embodiments, the magnetic angled support flap retainer 655 is configured to interact with one or more sensors of a portable electronic device 101 such that the change in magnetic field caused by opening the case 600 triggers the portable electronic device 101 to wake up or power up and the change in magnetic field caused by closing the case 600 triggers the portable electronic device 101 to sleep or power down.

In some embodiments, the angled support flap retainer 655 comprises at least one bistable spring having a first stable position corresponding to the folded position of the angled support flap 650 and a second stable position corresponding to the extended position of the angled support flap 650. The bistable spring attaches to the angled support flap 650 and to the second panel 130. In some embodiments, the bistable spring passes through the angled flap connector 551. In other embodiments, the bistable spring is located adjacent to the angled flap connector 551. In some embodiments, the third rotation limiter 656 is omitted because a bistable spring is used to bias the angled support flap 650 in a folded position or an open position. In other embodiments, the third rotation limiter 656 acts conjunction with a bistable spring to limit the rotation of the angled support flap 650.

As illustrated in the embodiments of FIGS. 6B and 6C, when the case 600 is arranged in the second opened configuration and the angled support flap 650 is in an extended position, the case 600 may be propped up upon a supporting surface such that the ends of the first panel 110 and the second panel 130 that are attached to the panel connector 160 are elevated above the supporting surface. The case may be selectively arranged in a landscape supported position (see FIG. 6B) and a portrait supported position (see FIG. 6C). The landscape supported position places a screen of the personal electronic device 101 at a third angle 680 relative to the surface upon which the case rests. This third angle 680 corresponds to a third viewing angle as the landscape supported position allows a user to view the screen at the third viewing angle. The portrait supported position places a screen of the personal electronic device 101 at a fourth angle 680 relative to the surface upon which the case rests. This fourth angle 680 corresponds to a fourth viewing angle as the portrait supported position allows a user to view the screen at the fourth viewing angle. The different angles of FIGS. 6B and 6C may allow for a user to select a preferred angle for a current task, such as reading, watching video, typing using a virtual keyboard, typing using a separate physical keyboard, or other task.

In some embodiments, angled support flap 650 may comprise one or more receptacles configured to receive flat items. For example, the receptacles may comprise card slots 153 and an ID slot 154. The card slots 153 may comprise slots or pockets located in the angled support panel 650 and configured to hold credit cards or similarly shaped objects. The ID slot 154 comprises a windowed card holder located on angled support panel 650 and is configured to hold an identification card or the like. In some embodiments a second ID slot 154 is provided in lieu of the one or more card slots 153 and vice versa. One of skill in the art will recognize considerable variation within the scope of the present disclosure regarding how a various pockets, card slots, and ID slots may be arranged on the angled support flap 650.

In some embodiments, the angled support flap 650 may be rigid or semi-rigid to maintain its shape. In one embodiment, a rigid or semi-rigid angled support flap 650 retains its planar shape and supports the case 600 and/or second panel 130 when the case 600 is configured in a landscape or a portrait supported position. For example, if the angled support flap 650 is extremely flexible it may not hold its shape enough to support the case 600 and/or portable electronic device 101 in the supported positions depicted in FIGS. 6B and 6C.

The angled support flap 650 may be formed of a variety of materials including a fabric, leather, plastic, composite, metal, or any other material. In some embodiments, an outer portion of the angled support flap 650 may be formed of a soft or protective material to reduce scratching of a portable electronic device 101. For example, a surface of the angled support flap 650 that faces the device receptacle 120 when the case 600 is in a closed configuration may be formed of a soft fabric, lint free cloth, suede leather or imitation suede leather, or the like. Other portions of the angled support flap 650 may include the same or other materials to provide a pleasing appearance to the case 600. In some embodiments, the angled support flap 650 may be formed of rigid or semi-rigid material such that the angled support flap 650 maintains its planar shape. For example, a portion of the angled support flap 650 may be formed of a variety of rigid or semi-rigid materials including a fabric, leather, plastic, composite, metal, or any other suitable material. Other portions of the angled support flap 650 may include the same or other materials to provide a pleasing appearance to the bifold case 100.

While the principles of this disclosure have been shown in various embodiments, many modifications of structure, arrangements, proportions, elements, materials, and components, which are particularly adapted for a specific environment and operating requirements, may be used without departing from the principles and scope of this disclosure.

These and other changes or modifications are intended to be included within the scope of the present disclosure.

The foregoing specification has been described with reference to various embodiments. However, one of ordinary skill in the art will appreciate that various modifications and changes can be made without departing from the scope of the present disclosure. Accordingly, this disclosure is to be regarded in an illustrative rather than a restrictive sense, and all such modifications are intended to be included within the scope thereof. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, a required, or an essential feature or element. As used herein, the terms "comprises," "comprising," and any other variation thereof, are intended to cover a non-exclusive inclusion, such that a process, a method, an article, or an apparatus that comprises a list of elements does not include only those elements but may include other elements not expressly listed or inherent to such process, method, system, article, or apparatus.

Those having skill in the art will appreciate that many changes may be made to the details of the above-described embodiments without departing from the underlying principles of the invention. The scope of the present invention should, therefore, be determined only by the following claims.

What is claimed is:

1. A case for a portable electronic device including a back side and a display side, the case comprising:

a first panel including a device receptacle configured to securely receive the portable electronic device, the device receptacle configured to enable access to the display side of the portable electronic device;

a second panel pivotally coupled to the first panel and including an outer side, an interior side, a proximate end, and an opposing distal end, the pivotal coupling of the first panel and second panel configured to provide an open configuration wherein the first and second panels are separated to enable access to the display side of the portable electronic device received in the device receptacle and to provide a closed configuration wherein the interior side extends over at least a majority of the display side of the portable electronic device received in the device receptacle, wherein the proximate end is proximate to the pivotal coupling with the first panel, and wherein the second panel has a length extending from the proximate end to the opposing distal end;

a first support flap pivotally coupled to the interior side of the second panel and, in the closed configuration, extending a majority of the length between the proximate and distal ends of the second panel, the first support flap, in the open configuration, configured to support the case in a first elevated position; and a second support flap pivotally coupled to the interior side of the second panel and, in the closed configuration, extending a minority of the length between the proximate and distal ends of the second panel, the second support flap, in the open configuration, configured to support the case in a second elevated position wherein in the closed configuration, the first support flap covers a majority of the interior side of the second panel and the second support flap covers a minority of the interior side of the second panel.

2. The case of claim 1, further comprising:

a first rotation limiter configured to limit the rotation of the first support flap to a first maximum rotation angle;

a second rotation limiter configured to limit the rotation of the second support flap to a second maximum rotation angle, wherein the first elevated position defines a first viewing angle, the second elevated position defines a second viewing angle, and the first viewing angle is different from the second viewing angle.

3. The case of claim 2, wherein the first rotation limiter and the second rotation limiter are configured to adjust the corresponding maximum rotation angle.

4. The case of claim 1, further comprising at least one flap retainer configured to selectively retain the first support flap or the second support flap in the closed configuration.

5. The case of claim 1, wherein the first support flap comprises one or more flap receptacles configured to receive items.

6. The case of claim 1, wherein the device receptacle comprises one or more openings configured to allow a user to manipulate controls on a side of the portable electronic device.

7. The case of claim 1, wherein the first and second support flaps include proximate and distal ends, wherein the first and second support flaps are pivotally coupled to the interior side of the second panel at corresponding proximate ends, wherein the distal end of the first support flap and the distal end of the second support flap are proximate to one another in the closed configuration.

8. The case of claim 7, wherein the distal end of the first support flap and the distal end of the second support flap are parallel to one another in the closed configuration.

9. The case of claim 1, wherein the first and second support flaps include proximate and distal ends, wherein the first and second support flaps are pivotally coupled to the interior side of the second panel at corresponding proximate ends, wherein the proximate end of the first support flap is proximate to the proximate end of the second panel and the proximate end of the second support flap is proximate to the distal end of the second panel.

10. A case for a portable electronic device including a back side and a display side, the case comprising:

a first panel;

a device receptacle coupled to the first panel and configured to receive and hold the portable electronic device;

a second panel pivotally coupled to the first panel and including an outer side, an interior side, a proximate end, and an opposing distal end, the pivotal coupling of the first panel and second panel configured to provide an open configuration wherein the first and second panels are separated to enable access to the display side of the portable electronic device received in the device receptacle and to provide a closed configuration wherein the interior side extends over at least a majority of the display side of the portable electronic device received in the device receptacle, wherein the proximate end is proximate to the pivotal coupling with the first panel, and wherein the second panel has a length extending from the proximate end to the opposing distal end;

a first support flap pivotally coupled to the interior side of the second panel, the first support flap including a contiguous, uninterrupted panel which, in the closed configuration, extends a majority of the length between the proximate and distal ends of the second panel, the first support flap, in the open configuration, configured to extend from the case and to support the case at a first viewing angle relative to a supporting surface; and a second support flap pivotally coupled to the interior side of the second panel and, in the closed configuration, extending a minority of the length between the proximate and distal ends of the second panel, the second support flap, in the open configuration, configured to extend from the case and to support the case at a second viewing angle relative to the supporting surface, wherein the first viewing angle is different than the second viewing angle, wherein the first and second support flaps include proximate and distal ends, wherein the first and second support flaps are pivotally coupled to the interior side of the second panel at corresponding proximate ends, and wherein the distal end of the first support flap and the distal end of the second support flap are proximate to one another in the closed configuration.

11. The case of claim 10, further comprising:

one or more first rotation limiters configured to limit the rotation of the first support flap to a first maximum rotation angle; and one or more second rotation limiters configured to limit the rotation of the second support flap to a second maximum rotation angle.

12. The case of claim 11, wherein the one or more second rotation limiters comprises a limiting strap that has an adjustable length; and wherein the second viewing angle is adjusted by changing the length of the limiting strap.

13. The case of claim 10, further comprising at least one flap retainer configured to selectively retain the first support flap or the second support flap in the closed configuration.

14. The case of claim 10, wherein the first support flap is further configured to support the case at a landscape orientation and at a portrait orientation.

15. The case of claim 10, wherein the second support flap is further configured to support the case at a third viewing angle.

16. A case for a portable electronic device including a back side and a display side, the case comprising:

a device receptacle configured to securely receive the portable electronic device;

a first panel coupled to the receptacle;

a second panel pivotally coupled to the first panel and including an outer side, an interior side, a proximate end, and an opposing distal end, the pivotal coupling of the first panel and second panel configured to provide an open configuration wherein the first and second panels are separated to enable access to the display side of the portable electronic device received in the device receptacle and to provide a closed configuration wherein the interior side extends over at least a majority of the display side of the portable electronic device received in the device receptacle, wherein the proximate end is proximate to the pivotal coupling with the first panel, and wherein the second panel has a length extending from the proximate end to the opposing distal end;

a first support flap pivotally coupled to the interior side of the second panel and, the first support flap including a contiguous, uninterrupted panel which, in the closed configuration, extends a majority of the length between the proximate and distal ends of the second panel, the first support flap, in the open configuration, configured to support the case in a first raised position, wherein, when in the first raised position, the case is at a first viewing angle relative to a supporting surface; and a second support flap pivotally coupled to the interior side of the second panel and, in the closed configuration, extending a minority of the length between the proximate and distal ends of the second panel, the second support flap, in the open configuration, configured to support the case in a second raised position, wherein, when in the second raised position, the case is selectively positionable at either a second viewing angle or at a third viewing angle, wherein the first support flap is shorter than the second support flap, wherein the first viewing angle is different than the second viewing angle, and wherein the third viewing angle is different than both the first viewing angle and the second viewing angle, wherein the first and second support flaps include proximate and distal ends, wherein the first and second support flaps are pivotally coupled to the interior side of the second panel at corresponding proximate ends, wherein the proximate end of the first support flap is proximate to the proximate end of the second panel and the proximate end of the second support flap is proximate to the distal end of the second panel.

17. The case of claim 16, wherein the second support flap is further configured to support the case at a landscape orientation and at a portrait orientation.

18. The case of claim 16, wherein the distal end of the first support flap and the distal end of the second support flap are proximate to one another in the closed configuration.

19. The case of claim 18, wherein the distal end of the first support flap and the distal end of the second support flap are parallel to one another in the closed configuration.

20. A case for a portable electronic device including a back side and a display side, the case comprising:

a first panel;

a device receptacle coupled to the first panel and configured to receive and support the portable electronic device;

a second panel including an outer side, an interior side, a proximate end, and an opposing distal end;

a panel connector coupled to the first and second panels and configured to foldably connect the first panel to the second panel, wherein the proximate end of the second panel is proximate to the coupling with the panel connector, and wherein the second panel has a length extending from the proximate end to the opposing distal end the foldable connection of the first panel and second panel configured to provide an open configuration wherein the first and second panels are separated to enable access to the display side of the portable electronic device received in the device receptacle and to provide a closed configuration wherein the interior side extends over at least a majority of the display side of the portable electronic device received in the device receptacle;

a first support flap pivotally coupled to the interior side of the second panel, the first support flap including a contiguous, uninterrupted panel which, in the closed configuration, extends a majority of the length between the proximate and distal ends of the second panel, the first support flap, in the open configuration, configured to support the case in a first raised position; and a second support flap pivotally coupled to the interior side of the second panel and, in the closed configuration, extending a minority of the length between the proximate and distal ends of the second panel, the second support flap, in the open configuration, configured to support the case in a second raised position, wherein the first support flap is shorter than the second support flap.

21. The case of claim 20, wherein the first support flap is pivotally coupled proximate to the proximate end of the second panel and the second support flap is pivotally coupled proximate to the distal end of the second panel.

22. The case of claim 20, wherein an axis of rotation of the pivotal coupling of the first support flap is parallel to an axis of rotation of the pivotal coupling of the second support flap.

* * * * *